US008657276B2

(12) United States Patent
Kato et al.

(10) Patent No.: US 8,657,276 B2
(45) Date of Patent: Feb. 25, 2014

(54) SHEET PROCESSING APPARATUS THAT DETECTS DISPLACEMENT IN SHEET WIDTH DIRECTION AND SKEW OF SHEET, IMAGE FORMING APPARATUS, AND CONTROL METHOD

(75) Inventors: Hitoshi Kato, Toride (JP); Naoki Ishikawa, Kashiwa (JP); Yasuo Fukatsu, Abiko (JP); Taishi Tomii, Toride (JP)

(73) Assignee: Canon Kabushiki Kaisha (JP)

( * ) Notice: Subject to any disclaimer, the term of this patent is extended or adjusted under 35 U.S.C. 154(b) by 36 days.

(21) Appl. No.: 13/568,306

(22) Filed: Aug. 7, 2012

(65) Prior Publication Data

US 2013/0036886 A1 Feb. 14, 2013

(30) Foreign Application Priority Data

Aug. 8, 2011 (JP) ..... 2011-172933

(51) Int. Cl.
*B65H 7/14* (2006.01)

(52) U.S. Cl.
USPC ..... 270/58.07

(58) Field of Classification Search
USPC ..... 270/58.07; 271/184, 227, 228; 83/79, 83/364, 367, 370
See application file for complete search history.

(56) References Cited

U.S. PATENT DOCUMENTS

| | | | | |
|---|---|---|---|---|
| 7,581,725 | B2 * | 9/2009 | Fujita et al. | 270/58.17 |
| 7,866,652 | B2 * | 1/2011 | Fujita et al. | 270/58.17 |
| 8,016,280 | B2 * | 9/2011 | Iguchi et al. | 270/58.07 |
| 8,146,907 | B2 * | 4/2012 | Kato et al. | 270/58.07 |
| 8,210,514 | B1 * | 7/2012 | Kato et al. | 270/58.07 |

FOREIGN PATENT DOCUMENTS

JP 2005-342943 A 12/2005

* cited by examiner

*Primary Examiner* — Leslie A Nicholson, III
(74) *Attorney, Agent, or Firm* — Rossi, Kimms & McDowell LLP

(57) ABSTRACT

A sheet processing apparatus capable of high-speed and accurate detection of a lateral displacement and a skew of a sheet. A motor laterally shifts the sensors during sheet conveyance by a conveying motor, to determine first and second positions of the sheet lateral edge detected respectively by first and second sensors. A finisher controller determines a third position of the lateral edge of the sheet closer to a sheet trailing edge, based on the first and second positions and an amount of conveyance of the sheet from when the first position is detected to when the second position is detected. A lateral displacement of the sheet is corrected by laterally shifting the sheet according to the third position of the sheet lateral edge.

8 Claims, 15 Drawing Sheets

SHEET PROCESSING APPARATUS THAT DETECTS DISPLACEMENT IN SHEET WIDTH DIRECTION AND SKEW OF SHEET, IMAGE FORMING APPARATUS, AND CONTROL METHOD

BACKGROUND OF THE INVENTION

1. Field of the Invention

The present invention relates to a sheet processing apparatus that performs post-processing on a sheet, an image forming apparatus, and a control method.

2. Description of the Related Art

Conventionally, post-processing, such as punching of holes in a sheet (recording sheet) on which an image has been formed by an image forming apparatus is executed by conveying the sheet to a sheet processing apparatus connected to the image forming apparatus. This type of sheet processing apparatus is equipped with a punching mechanism for punching holes in a sheet, and corrects a displacement of the sheet in a sheet width direction orthogonal to a sheet conveying direction (hereinafter referred to as a "lateral displacement") so as to enhance accuracy of punching positions on the sheet when punching holes in the sheet.

Further, in the sheet processing apparatus, to attain high productivity in which a sheet processing amount is high, there is a case where the amount of lateral displacement of a sheet is detected during conveyance of the sheet whereby the lateral displacement is corrected. As a method of detecting a lateral displacement amount, there has been proposed a method of shifting an optical sensor in the sheet width direction, and detecting the lateral displacement amount based on the time of detection of an edge (lateral edge) of the sheet in the sheet width direction.

When the detection of a lateral displacement amount is executed as described above during conveyance of a sheet, the conveyance amount of the sheet conveyed after the sensor starts to be shifted until it reaches the lateral edge of the sheet is different depending on the lateral displacement amount, and hence the position of detection of the lateral edge of the sheet varies in the sheet conveying direction. This makes it difficult to always detect the lateral displacement amount at a fixed position. Further, when the sheet is skewed, an error can occur between the detected lateral displacement amount and a lateral displacement amount at a trailing edge of the sheet where holes are to be punched. Therefore, to enhance accuracy of punching positions on the sheet, it is required to take a skew feeding rate of the sheet into account when the lateral displacement is corrected.

As a method of detecting a skew feeding rate of a sheet, there has been proposed a method of detecting a lateral displacement and a skew simultaneously in the image forming apparatus (see Japanese Patent Laid-Open Publication No. 2005-342943). In the method disclosed in this publication, a lateral displacement sensor for detecting lateral displacements, disposed at the lateral edge of the sheet, is caused to reciprocate a plurality of times, whereby at least two lateral displacements of the sheet are detected, and a skew feeding rate is detected based on the difference between the results of detection of a plurality of lateral edge positions.

As described above, in the conventional technique, the lateral displacement sensor is caused to reciprocate a plurality of times to thereby detect a plurality of lateral displacements. However, when a sheet conveying speed is increased, there is a fear that after detecting a first lateral edge position of the sheet, the lateral displacement sensor cannot complete detection of second et seq. lateral edge positions of the sheet before the trailing edge of the sheet passes the lateral displacement sensor. To cope with this problem, it is necessary to limit the sheet conveying speed, but if the sheet conveying speed is limited, the productivity of sheet processing can be degraded.

As a method of increasing the productivity of sheet processing, there has been proposed one in which a plurality of lateral displacement amounts are detected by forward and backward operations of the reciprocating operation of the lateral displacement sensor. However, in the lateral displacement sensor, to prevent erroneous detection by noise, threshold voltage of a light receiving circuit is sometimes provided with hysteresis between off to on and on to off (hereinafter referred to as the "directions of detection") in switching of the lateral displacement sensor. This can cause an error in detection of the lateral edge position due to different directions of detection of the lateral displacement sensor.

SUMMARY OF THE INVENTION

The present invention provides a sheet processing apparatus that makes it possible to achieve high-speed and accurate detection of a displacement of a sheet in a sheet width direction orthogonal to a sheet conveying direction, and s skew of the sheet, an image forming apparatus, and a control method.

In a first aspect of the present invention, there is provided a sheet processing apparatus comprising a conveying unit configured to convey a sheet, a first detection unit and a second detection unit arranged in a sheet width direction orthogonal to a sheet conveying direction and configured to detect an edge of the conveyed sheet in the sheet width direction, respectively, a first shift unit configured to cause the first detection unit and the second detection unit to shift in the sheet width direction, a second shift unit configured to cause the sheet to shift in the sheet width direction, a first determination unit configured to determine, by causing the first shift unit to cause the first detection unit and the second detection unit to shift, during conveyance of the sheet by the conveying unit, a first position of the edge of the sheet in the sheet width direction, the first position being detected by the first detection unit, and then a second position of the edge of the sheet in the sheet width direction, the second position being detected by the second detection unit, a second determination unit configured to determine a third position of the edge of the sheet in the sheet width direction, the third position being closer to a trailing edge of the sheet than the second position is, based on the first position and the second position determined by the first determination unit, and an amount of conveyance of the sheet till the second position is detected after the first position is detected, and a correction unit configured to correct a displacement of the sheet in the sheet width direction, by causing the second shift unit to shift the sheet in the sheet width direction, according to the third position determined by the second determination unit.

In a second aspect of the present invention, there is provided a method of controlling a sheet processing apparatus including a conveying unit configured to convey a sheet, a first detection unit and a second detection unit arranged in a sheet width direction orthogonal to a sheet conveying direction and configured to detect an edge of the conveyed sheet in the sheet width direction, respectively, a first shift unit configured to cause the first detection unit and the second detection unit to shift in the sheet width direction, and a second shift unit configured to cause the sheet to shift in the sheet width direction, the method comprising determining, by causing the first shift unit to cause the first detection unit and the second detection unit to shift, during conveyance of the sheet by the conveying unit, a first position of the edge of the sheet in the sheet width direction, the first position being detected by the first detection unit, and then a second position of the edge of the sheet in the sheet width direction, the second position being detected by the second detection unit, determining a third position of the edge of the sheet in the sheet width direction, the third position being closer to a trailing edge of the sheet than the second position is, based on the first position and the second position determined by the determining, and an amount of conveyance of the sheet till the second position is detected after the first position is detected, and correcting a displacement of the sheet in the sheet width direction, by causing the second shift unit to shift the sheet in the sheet width direction, according to the determined third position.

According to the present invention, a plurality of detection units are arranged in a sheet width direction orthogonal to a sheet conveying direction, and by shifting the detection units in one direction, it is possible, while conveying the sheet, to detect lateral edge positions of the sheet in the sheet width direction, at a plurality of points of the sheet in the sheet conveying direction. This makes it possible to detect a displacement amount of the sheet in the sheet width direction and a skew of the sheet at higher speed, compared with the conventional case where a detection unit is caused to reciprocate. Further, since the detection by the detection units can be performed in one direction, it is possible to detect an amount of displacement of the sheet in the sheet width direction and a skew of the sheet with high accuracy.

Further features of the present invention will become apparent from the following description of exemplary embodiments with reference to the attached drawings.

BRIEF DESCRIPTION OF THE DRAWINGS

FIGS. 3A to 3C are views of a punching unit of the sheet processing apparatus, in which FIG. 3A shows a punching section of the punching unit, as viewed in a direction indicated by an arrow in FIG. 2, FIG. 3B shows the punching section of the punching unit, as viewed from upstream in a sheet conveying direction, and FIG. 3C is a cross-sectional view of part of the punching unit along a cam member.

FIGS. 5A and 5B are views showing positional relationships between a sheet and a lateral displacement sensor, in which FIG. 5A shows one of the positional relationships in a case where the lateral displacement sensor is turned from off to on, and FIG. 5B shows the other of the positional relationships in a case where the lateral displacement sensor is turned from on to off.

DESCRIPTION OF THE EMBODIMENTS

The present invention will now be described in detail below with reference to the accompanying drawings showing embodiments thereof.

Figure 1:
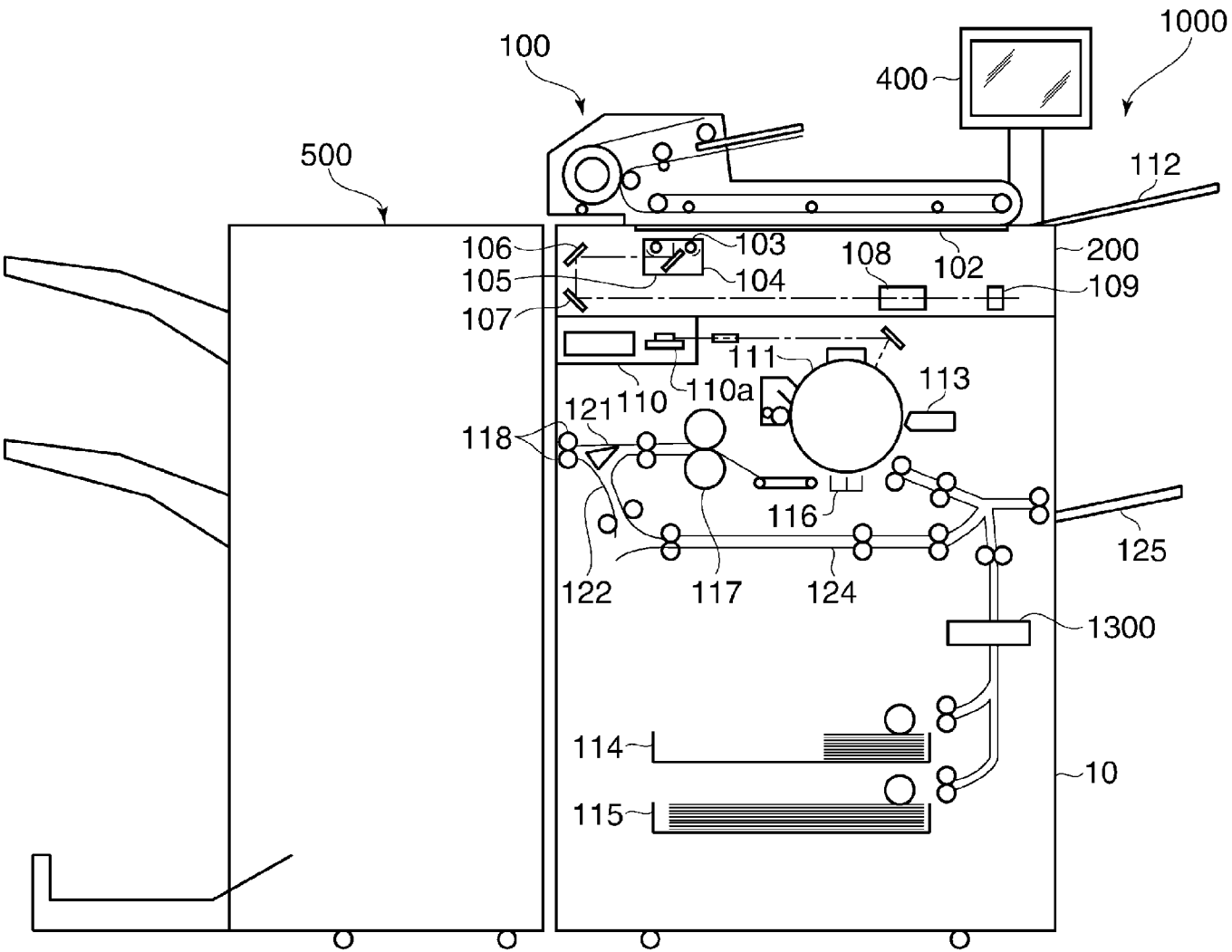
FIG. 1 is a schematic diagram of an image forming system according to an embodiment of the present invention.

FIG. 1 is a schematic diagram of an image forming system according to an embodiment of the present invention.

Referring to FIG. 1, the image forming system 1000 comprises an image forming apparatus including an image forming apparatus main unit 10, a document feeder 100, an image reader 200, and an operation and display unit 400, and a sheet processing apparatus 500 connected to a sheet discharge side of the image forming apparatus. Note that in describing the image forming apparatus, the outline of image reading and image formation executed by the image forming apparatus will be described, and description of other processing executed thereby is omitted or simplified, as deemed appropriate.

The document feeder 100 feeds originals placed on an original tray one by one, conveys each original onto a platen glass 102, and then discharges the original onto a discharge tray 112. As each original passes a reading position, light is irradiated onto the original from a lamp 103 of a scanner unit 104 of the image reader 200, and reflected light from the original is guided to a lens 108 via mirrors 105, 106, and 107. Light having passed through the lens 108 forms an image on an image sensor 109, which is converted to image data, and then the image data is output from the image sensor 109.

The image data is subjected to predetermined processing by an image signal controller 202 (FIG. 6), referred to hereinafter, and is then input to an exposure controller 110 of the image forming apparatus main unit 10 as a video signal. The exposure controller 110 modulates a laser beam based on the video signal and outputs the same. The laser beam is scanned by a polygon mirror 110*a* to be irradiated onto a photosensitive drum 111, whereby an electrostatic latent image is formed on the photosensitive drum 111.

The electrostatic latent image on the photosensitive drum 111 is visualized as a developer image by a developer supplied from a developing device 113. Further, a sheet is fed from one of sheet feed cassettes 114 and 115, a manual sheet feeder 125, and a double-sided conveying path 124, in timing synchronous with the start of the irradiation of the laser beam, and is conveyed between the photosensitive drum 111 and a transfer section 116. The developer image on the photosensitive drum 111 is transferred onto the sheet by the transfer section 116.

The sheet having the developer image transferred thereon is conveyed to a fixing section 117, where the developer image is fixed on the sheet by heating and pressing the sheet. The sheet having passed through the fixing section 117 passes through a flapper 121 and a discharge roller pair 118, and is discharged from the image forming apparatus main unit 10. Then the sheet is conveyed to the sheet processing apparatus 500.

Although the flapper 121 and an inversion path 122 are used when the sheet is to be discharged face-down, i.e. with an image-formed surface thereof facing downward, detailed description thereof is omitted. Further, when the sheet is to be discharged face-up, i.e. with the image-formed surface thereof facing upward, the sheet is discharged as it is, using the discharge roller pair 118. Further, when image formation is performed on both sides of a sheet, the sheet having an image formed on one surface thereof is guided into the inversion path 122 by a switching operation of the flapper 121, and is then conveyed to the double-sided conveying path 124. Then, the sheet is fed in again between the photosensitive drum 111 and the transfer section 116, whereby an image is formed on the other surface thereof.

Figure 2:
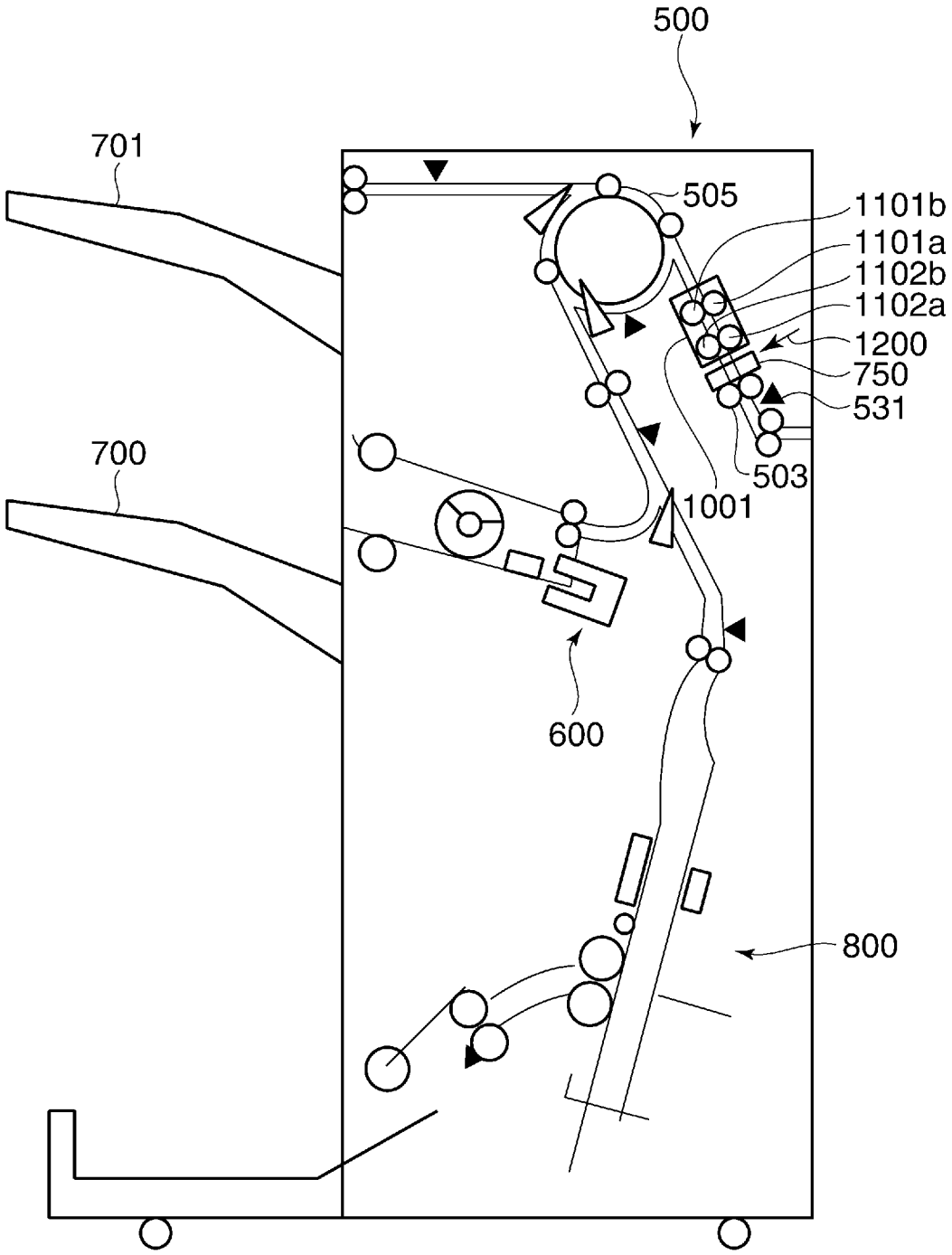
FIG. 2 is a schematic diagram of a sheet processing apparatus.

FIG. 2 is a schematic diagram of the sheet processing apparatus.

Referring to FIG. 2, the sheet processing apparatus 500 receives sheets conveyed from the image forming apparatus main unit 10, and performs various types of post-processing, including processing for aligning the received sheets into a bundle, sort processing, non-sort processing, staple processing (binding processing) for stapling a trailing end of a sheet bundle, punching processing for punching holes in a trailing end of a sheet, and bookbinding processing for binding a sheet bundle.

The sheet processing apparatus 500 comprises a punching unit 750 for punching holes in sheets, a stapling unit 600 for stapling sheets, and a bookbinding unit 800 for folding a sheet bundle in two and bookbinding the same. Further, the sheet processing apparatus 500 comprises a conveying roller pair 503, a buffer roller 505, an inlet sensor 531, and a lateral registration shift unit 1001. Furthermore, the sheet processing apparatus 500 comprises a tray 700 for stacking sheets which have been normally processed, and a proof tray 701 for stacking sheets determined to have been abnormally processed.

The inlet sensor 531 detects a sheet conveyed from the image forming apparatus main unit 10 at a location close to the inlet of a sheet conveying path. The lateral registration shift unit 1001 is disposed between the conveying roller pair 503 and the buffer roller 505. When in a shift sorting mode for discharging each sheet after transversely offsetting the same or a punch mode for punching holes in each sheet, the lateral registration shift unit 1001 conveys the sheet in a state shifted to a predetermined position in the sheet width direction.

Figures 3A, 3B, 3C:
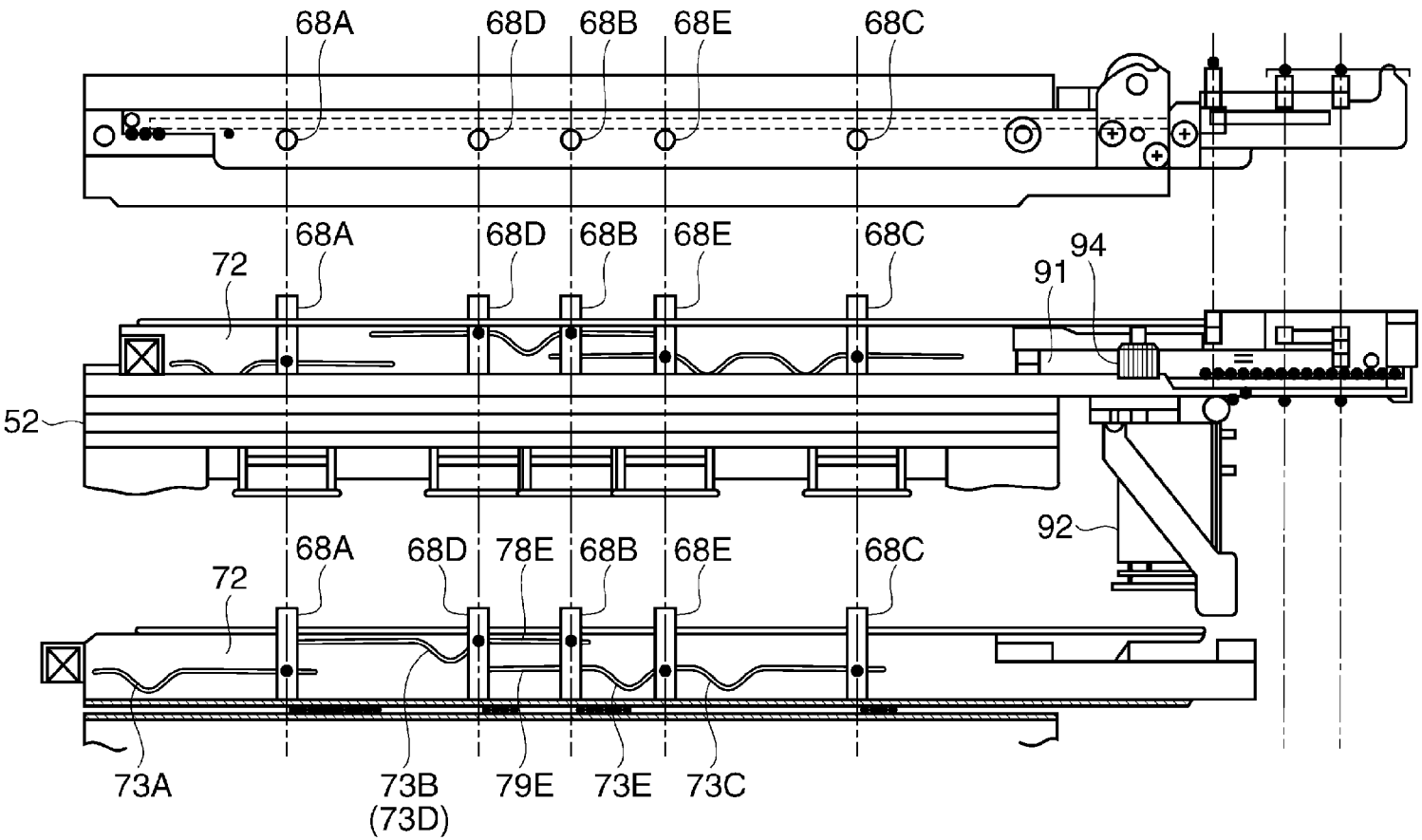

FIGS. 3A to 3C are views of the arrangement of the punching unit of the sheet processing apparatus, in which FIG. 3A shows a punching section of the punching unit, as viewed in a direction indicated by an arrow 1200 in FIG. 2, FIG. 3B shows the punching section of the punching unit, as viewed from upstream in a sheet conveying direction, and FIG. 3C is a cross-sectional view of part of the punching unit along a cam member.

In FIG. 3C, a cam 73A at the left end of the punching unit is a three-hole-punching cam, with which a three-hole punch 68A appearing in FIGS. 3A and 3B is engaged. The length of a right-side straight line portion of the cam 73A is longer than that of a left-side straight line portion thereof.

A cam 73B (73D) second from the left end of the punching unit is used both as a three-hole-punching cam and as a two-hole-punching cam, and a central three-hole punch 68B of three-hole punches appearing in FIGS. 3A and 3B, and a left-side two-hole punch 68D of two-hole punches appearing in FIGS. 3A and 3B are engaged with the cam 73B (73D). Since the cam 73B (73D) is commonly used by the three-hole punch 68B and the two-hole punch 68D, it is possible to reduce not only the number of cams but also spacing between the three-hole punch 68B and the two-hole punch 68D.

A two-hole-punching cam 73E third from the left end and a three-hole-punching cam 73C fourth from the left end are formed such that straight-line portions thereof communicate with each other. A right-side two-hole punch 68E of the two-hole punches appearing in FIGS. 3A and 3B is engaged with the two-hole-punching cam 73E. A right-side three-hole punch 68C of the three-hole punches appearing in FIGS. 3A and 3B is engaged with the three-hole-punching cam 73C.

Out of the above straight line portions of the cams, the lengths of the following straight line portions are set to be approximately equal to each other: The length of the right-side straight line portion of the three-hole-punching cam 73A at the left end of the punching unit, the lengths of the left and right straight line portions of the cam 73B (73D) second from the left end of the punching unit, used both as a three-hole-punching cam and as a two-hole-punching cam, the length of a left-side straight line portion 79E of the two-hole-punching cam 73E third from the left end of the punching unit, and the length of a right-side straight line portion of the three-hole-punching cam 73C fourth from the left end of the punching unit.

Further, the three-hole-punching cam 73A at the left end of the punching unit, the two-hole-punching cam 73E third from the left end, and the three-hole-punching cam 73C fourth from the left end are formed at the same level. Further, the cam 73B (73D) second from the left end, used both as a three-hole-punching cam and as a two-hole-punching cam, is formed at a position higher than the other three cams in FIG. 3C.

With the above-described arrangement, the end of the right-side straight line portion of the three-hole-punching cam 73A at the left end of the punching unit, and the end of the left-side straight line portion of the cam 73B (73D) second from the left end of the punching unit, used both as a three-hole-punching cam and as a two-hole-punching cam, can be made opposed to each other in a vertical direction. Further, a right-side straight line portion 78E of the above-mentioned cam 73B (73D) and the left-side straight line portion 79E of the two-hole-punching cam 73E third from the left end of the punching unit can be made opposed to each other substantially in their entirety. Therefore, it is possible to arrange the punches 68A, 68B, 68C, 68D and 68E with standardized spacing.

Further, the cams 73A, 73B, 73C, 73D, and 73E are configured such that they are displaced in a direction of movement of the punches 68A, 68B, 68C, 68D and 68E so as to prevent the cams from being continuous with each other, so that it is possible to prevent an undesired punch from being unnecessarily operated.

Furthermore, although the three-hole punches 68A, 68B, and 68C are arranged at equally-spaced intervals, the three-hole-punching cam 73A at the left end of the punching unit, the cam 73B (73D) second from the left end of the punching unit, used both as a three-hole-punching cam and as a two-hole-punching cam, and the three-hole-punching cam 73C fourth from the left end are arranged at unequally-spaced intervals. Moreover, spacing between the three-hole punches is different from spacing between the three-hole-punching cams. Similarly, spacing between the two-hole punches 68D and 68E is different from spacing between the two-hole-punching cams 73D and 73E.

This is because when a cam member 72 is moved to cause the three-hole punches or the two-hole punches to punch holes in a sheet, the three three-hole punches or the two two-hole punches are each operated with some time difference or delay therebetween to punch holes in the sheet. As a consequence, a cam member-driving motor 92, described hereinafter, is smoothly driven without being overloaded.

A rack 91 is formed at the right end of the cam member 72. A pinion 94 which is rotated by the cam member-driving motor 92 provided on a movable frame 52 meshes with the rack 91. The cam member-driving motor 92 is driven, whereby holes are punched in a sheet.

Figure 4:
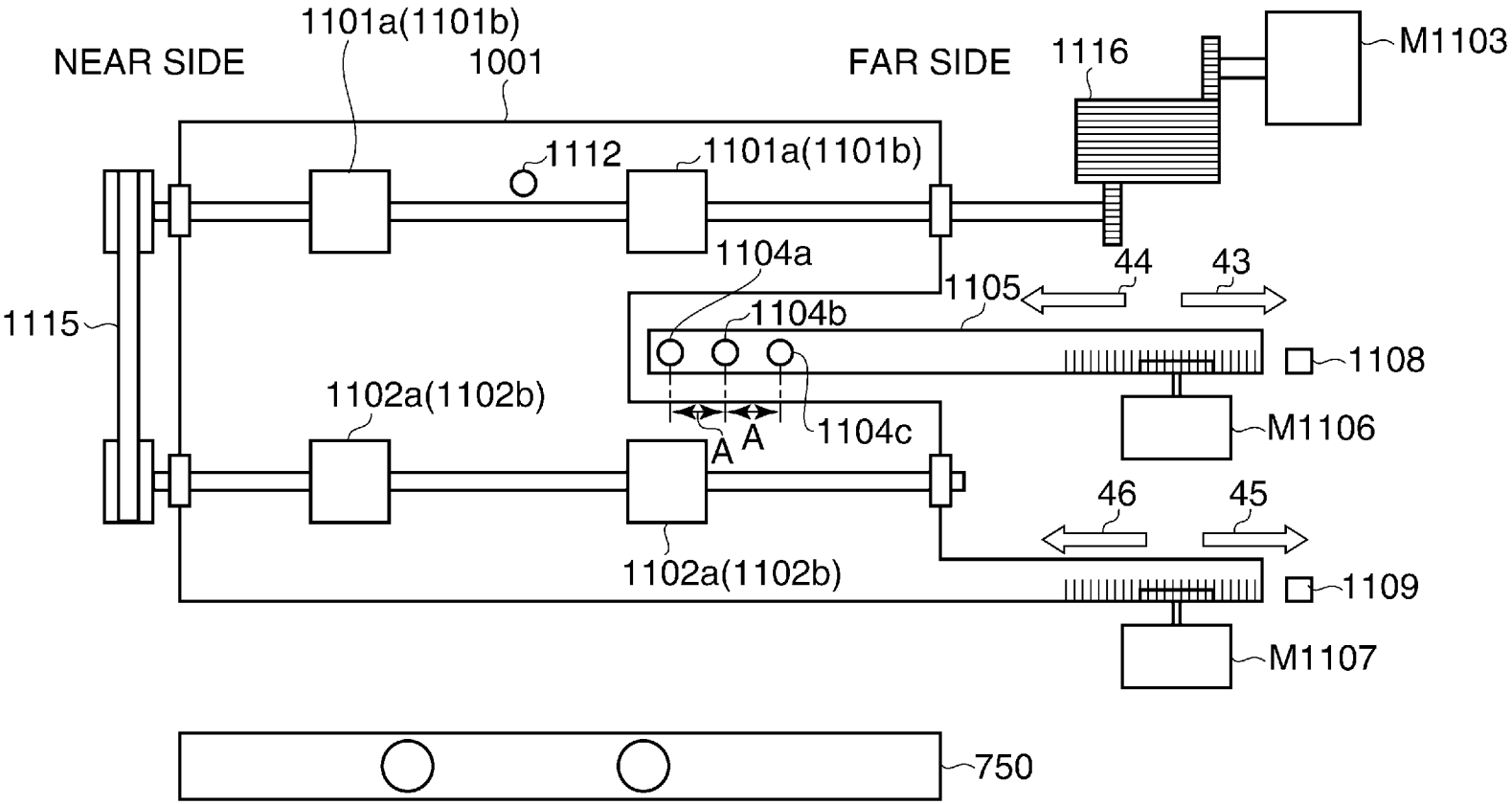
FIG. 4 is a view of a lateral registration shift unit and associated members therearound of the sheet processing apparatus.

FIG. 4 is a view of a lateral registration shift unit and associated members therearound of the sheet processing apparatus.

Referring to FIG. 4, the lateral registration shift unit 1001 comprises conveying rollers 1101*a* and 1102*a*, driven rollers 1101*b* and 1102*b* (components of a conveying unit), and a sheet detection sensor 1112, and is configured to be capable of shifting to a standby position dependent on the size of each sheet. The conveying rollers 1101*a* and 1102*a* are driven by a conveying motor M1103 (a component of the conveying unit) via a gear 1116 and a timing belt 1115, and convey each sheet in cooperation with the driven rollers 1101*b* and 1102*b*.

On a lateral displacement sensor unit 1105, there are mounted lateral displacement sensors 1104*a*, 1104*b*, and 1104*c* (first detection unit, second detection unit), which are configured to shift in the same direction. A lateral edge position of a conveyed sheet is detected by the lateral displacement sensor 1104*a*, 1104*b*, or 1104*c*.

As shown in FIG. 4, the lateral displacement sensors 1104*a*, 1104*b*, and 1104*c* are arranged with spacing of A mm from each other in the sheet width direction orthogonal to the sheet conveying direction. Specifically, the sensor spacing (A mm) is approximately 10 mm, for example. The lateral displacement sensors 1104*a*, 1104*b*, and 1104*c* have the same configuration, and each include a light emitter and a light receiver. Further, the lateral displacement sensors 1104*a*, 1104*b*, and 1104*c* shift in unison with each other. Note that although in the present embodiment, three lateral displacement sensors are arranged, this is not limitative, but there may be arranged at least two lateral displacement sensors. When at least three lateral displacement sensors are arranged, one of the sensors is selected for use according to a position of a conveyed sheet in the sheet width direction.

Figure 5A:
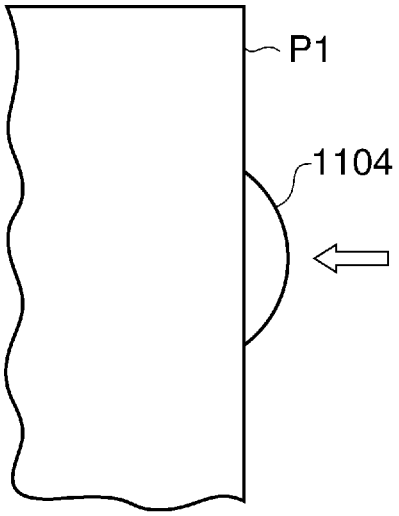
Figure 5B:
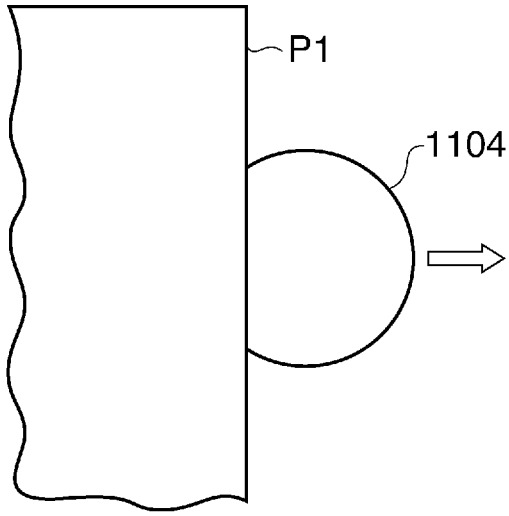

FIGS. 5A and 5B are views showing positional relationships between a sheet and a lateral displacement sensor 1104, in which FIG. 5A shows a positional relationship in a case where the lateral displacement sensor 1104 is turned from off to on, and FIG. 5B shows a positional relationship obtained in a case where the lateral displacement sensor 1104 is turned from on to off. Arrows appearing in FIGS. 5A and 5B indicate the shifting directions of the lateral displacement sensor 1104.

Referring to FIGS. 5A and 5B, the light receiving circuit of the lateral displacement sensor 1104 (1104*a*, 1104*b*, 1104*c*) is caused to operate with hysteresis. Therefore, as shown in FIGS. 5A and 5B, the position where an edge of a sheet in the sheet width direction orthogonal to the sheet conveying direction is detected is different between when the lateral displacement sensor 1104 is turned from off to on and when it is turned from on to off.

Referring again to FIG. 4, a lateral displacement sensor-shifting motor M1106 (first shift unit) shifts the lateral displacement sensor unit 1105 having the lateral displacement sensors 1104*a*, 1104*b*, and 1104*c* mounted thereon in lateral directions (sheet width directions), as indicated by arrows 43 and 44. The standby position (home position (HP)) of the lateral displacement sensor unit 1105 is detected by a lateral registration HP sensor 1108.

A lateral registration shift motor M1107 (second shift unit) drives the lateral registration shift unit 1001 provided separately from the lateral displacement sensor unit 1105 in the lateral directions (sheet width directions), as indicated by arrows 45 and 46. The standby position (home position (HP)) of the lateral registration shift unit 1001 is detected by a lateral registration HP sensor 1109.

The sheet detection sensor 1112 of the lateral registration shift unit 1001 detects a conveyed sheet, and detects that the trailing edge of the sheet has passed through the conveying rollers 1101*a* and the driven rollers 1101*b* of the lateral registration shift unit 1001.

Figure 6:
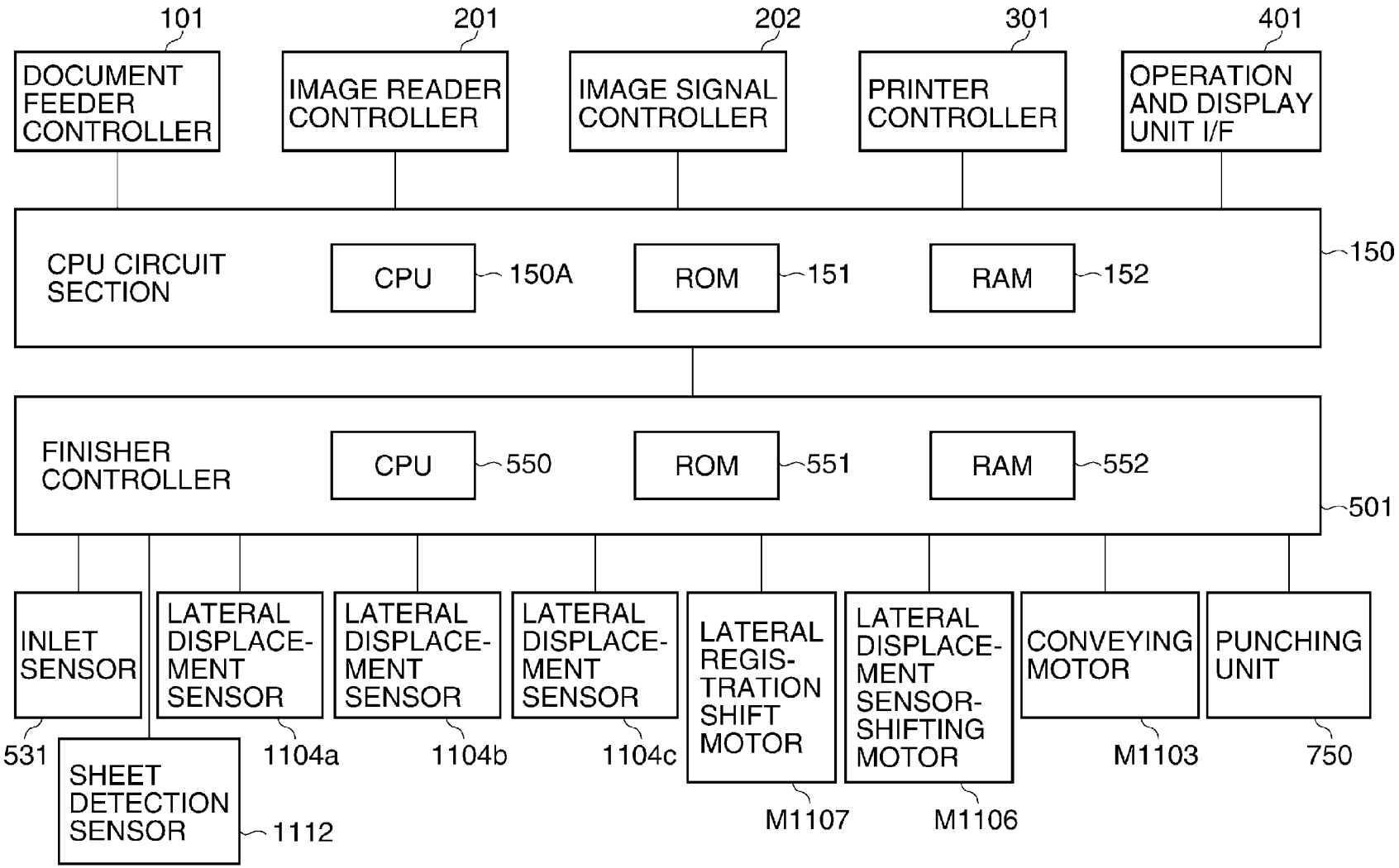
FIG. 6 is a block diagram of a control system of an image forming apparatus and the sheet processing apparatus.

FIG. 6 is a block diagram of control systems of the image forming apparatus and the sheet processing apparatus.

Referring to FIG. 6, the image forming apparatus main unit 10 of the image forming apparatus includes a CPU circuit section 150 incorporating a CPU 150A, a ROM 151, and a RAM 152. Further, the sheet processing apparatus 500 includes a finisher controller 501 incorporating a CPU 550, a ROM 551, and a RAM 552.

First, the CPU circuit section 150 and components associated therewith of the image forming apparatus will be described. The CPU 150A of the CPU circuit section 150 carries out the following control operations by control programs read from the ROM 151: The CPU 150A performs centralized overall control of the operations of a document feeder controller 101, an image reader controller 201, the image signal controller 202, a printer controller 301, a operation and display unit interface 401, and the finisher controller 501. The RAM 152 temporarily stores control data, and is also used as a work area for carrying out arithmetic operations involved in control processing.

The document feeder controller 101 drivingly controls the document feeder 100 according to instructions from the CPU circuit section 150. The image reader controller 201 drivingly controls the scanner unit 104, the image sensor 109, and so forth, of the image reader 200, and transfers an analog image signal output from the image sensor 109 to the image signal controller 202.

The image signal controller 202 converts the analog image signal to a digital signal, then performs various kinds of processing on the digital signal, converts the processed digital signal to a video signal, and then delivers the video signal to the printer controller 301. The printer controller 301 drives the exposure controller 110 based on the video signal.

The operation and display unit interface 401 exchanges information between the operation and display unit 400 (FIG. 1) and the CPU circuit section 150. Further, the operation and display unit interface 401 outputs key signals corresponding to respective key operations from the operation and display unit 400 to the CPU circuit section 150, and displays the corresponding pieces of information based on signals from the CPU circuit section 150 on the display of the operation and display unit 400.

Next, a description will be given of the arrangement of the sheet processing apparatus 500, including the finisher controller 501 as the center of control. The finisher controller 501 exchanges information with the CPU circuit section 150 to thereby control the overall operation of the sheet processing apparatus 500, and functions as a determination unit, a correction unit, a selection unit, and a punching control unit. Note that the finisher controller 501 may be provided in the image forming apparatus.

Further, the finisher controller 501 communicates with the CPU circuit section 150 via a communication IC (not shown) for data exchange, and executes various programs read from the ROM 551 to control the driving of the sheet processing apparatus 500 according to instructions from the CPU circuit section 150.

Further, the finisher controller 501 performs the following control operations based on respective detection signals from the inlet sensor 531, the sheet detection sensor 1112, and the lateral displacement sensors 1104*a*, 1104*b*, and 1104*c*. That is, the finisher controller 501 controls the lateral registration shift motor M1107, the lateral displacement sensor-shifting motor M1106, the conveying motor M1103, and the punching unit 750.

Further, the finisher controller 501 selects one of the lateral displacement sensors 1104*a* to 1104*c* to be used for detecting an edge of a sheet in the sheet width direction, depending on states of detection (on/off states) of the lateral displacement sensors, at the time of starting detection of the amount of lateral displacement of the sheet (amount of displacement of the sheet in the sheet width direction orthogonal to the sheet conveying direction). Further, the finisher controller 501 controls the positions of holes to be punched in the sheet by the punching unit 750, based on the amount of lateral displacement of the sheet computed in a lateral displacement amount-detecting process. The lateral displacement amount-detecting process will be described in detail hereinafter with reference to FIGS. 9 to 11.

Next, the operation of the thus configured sheet processing apparatus of the image forming system according to the present embodiment will be described in detail with reference to FIGS. 7 to 15.

First, a description will be given of control performed in a case where the sheet processing apparatus is instructed by the image forming apparatus to perform punching processing for punching holes in a sheet, with reference to the flowchart in FIG. 7 and FIG. 8. The following control is executed by the finisher controller 501 of the sheet processing apparatus, according to an instruction for executing the punching processing, which is received from the CPU circuit section 150 of the image forming apparatus. Note that in the sheet processing apparatus, correction of a lateral displacement amount is not performed unless punching processing is instructed by the image forming apparatus.

Figure 7:
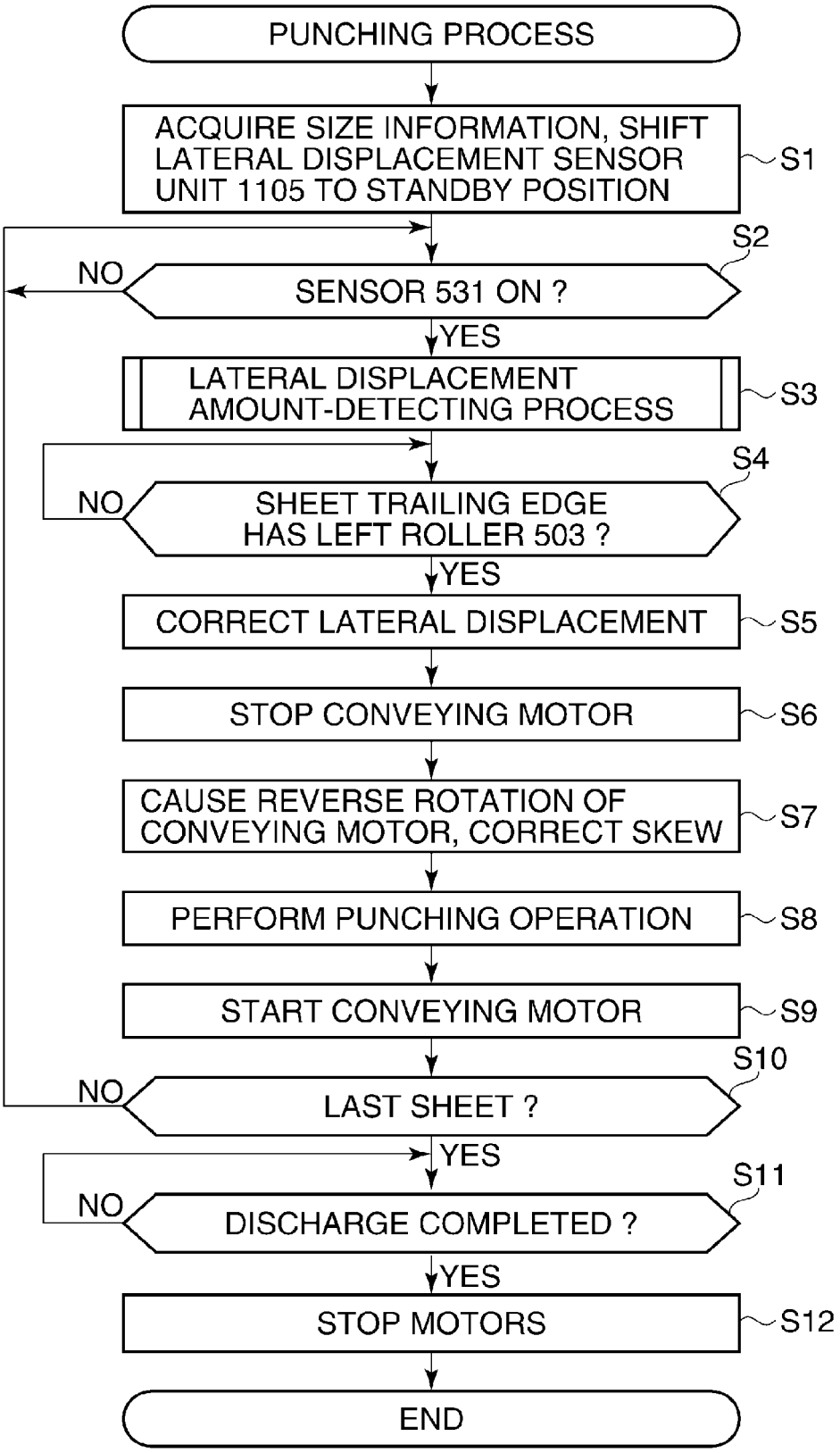
FIG. 7 is a flowchart of a punching process executed by the sheet processing apparatus.

FIG. 7 is a flowchart of a punching process executed by the sheet processing apparatus.

Referring to FIG. 7, first, the finisher controller 501 of the sheet processing apparatus acquires size information indicative of the size of sheets from the CPU circuit section 150 of the image forming apparatus, and causes the lateral displacement sensor unit 1105 to be shifted to a standby position according to the sheet size (step S1). The standby position is a position where at least two of the lateral displacement sensors 1104*a*, 1104*b*, and 1104*c* are off at the time of starting the lateral displacement amount-detecting process, irrespective of variation in the position of each conveyed sheet in the sheet width direction vary.

Figure 8:
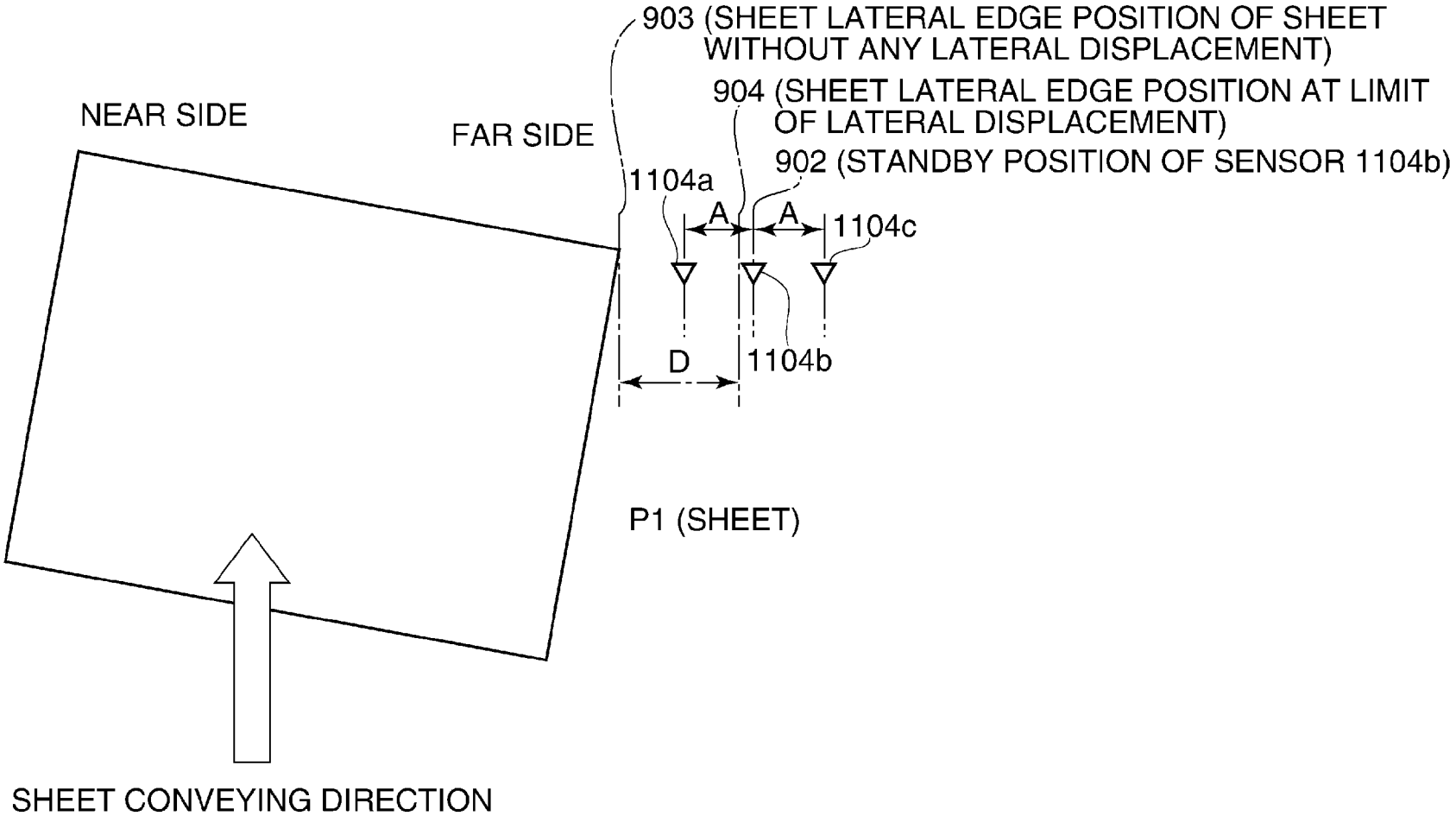
FIG. 8 is a view showing the relationship between a sheet and a standby position of a lateral displacement sensor unit.

FIG. 8 is a view showing the relationship between a sheet P1 and the standby position of the lateral displacement sensor unit 1105. As shown in FIG. 8, the standby position of the lateral displacement sensor unit 1105 is set such that the lateral displacement sensor 1104*b* is at a sheet lateral edge position 904 of the sheet P1 (position of an edge of the sheet P1 in the sheet width direction) corresponding to a limit of lateral displacement, which is D mm away from a sheet lateral edge position 903 of the sheet P1 without any lateral displacement. The sheet lateral edge position 904 is a position at which the maximum lateral displacement which can be corrected becomes maximum. Further, a standby position 902 of the lateral displacement sensor 1104*b* is farther from the center position in the sheet width direction than the position 904 is. Note that in the present specification, a near side is a front side of the sheet processing apparatus (side toward the viewer viewing FIG. 2), and the far side is a depth side of the sheet processing apparatus (side remote from the viewer viewing FIG. 2).

Next, the finisher controller 501 waits for the inlet sensor 531 to be turned on (step S2). When the inlet sensor 531 is turned on, the finisher controller 501 executes the lateral displacement amount-detecting process for detecting the amount of lateral displacement of a sheet (step S3). The lateral displacement amount-detecting process will be described hereinafter with reference to FIG. 9 et seq.

Next, the finisher controller 501 waits for the trailing edge of the sheet to leave the conveying roller pair 503 (step S4). It is determined whether or not the trailing edge of the sheet leaves the conveying roller pair 503, based on a distance over which the sheet has been conveyed after the turn-off of the inlet sensor 531.

After the inlet sensor 531 is turned off and the trailing edge of the sheet P1 leaves the conveying roller pair 503, the finisher controller 501 performs the following correction: The finisher controller 501 corrects the lateral displacement of the sheet by shifting the lateral registration shift unit 1001 in the sheet width direction orthogonal to the sheet conveying direction, based on the lateral displacement amount of the sheet detected in the step S3 (step S5).

Then, the finisher controller 501 once stops the conveying motor M1103 that drives the conveying rollers 1101*a* and 1102*a* for conveying the sheet (step S6). Next, the finisher controller 501 causes reverse rotation of the conveying motor M1103, and brings the sheet into abutment with a stopper (not shown) to thereby correct skew of the trailing end of the sheet (step S7).

Next, the finisher controller 501 causes the punching unit 750 to perform a punching operation on the trailing end of the sheet P1 in the sheet conveying direction, with the sheet held in abutment with the stopper (step S8). After termination of the punching operation on the sheet, the finisher controller 501 starts the conveying motor M1103 (step S9) to restart conveyance of the sheet.

Next, the finisher controller 501 determines whether or not the sheet P1 having been conveyed from the image forming apparatus is the last sheet to be conveyed, based on communication with the CPU circuit section 150 (step S10). If the conveyed sheet is not the last one, the process returns to the step S2. If the conveyed sheet is the last one, the finisher controller 501 waits until discharge of the sheet P1 onto the tray 700 or the proof tray 701 has been completed (step S11). When the discharge of the sheet P1 has been completed, the finisher controller 501 stops the motors including the conveying motor M1103 (step S12), followed by terminating the present process.

Next, the lateral displacement amount-detecting process in the step S3 in FIG. 7 will be described in detail with reference to FIGS. 9 to 15. The lateral displacement amount-detecting process is executed for detecting a lateral displacement amount of a sheet, which is used in lateral registration correction of the sheet P1.

Figure 9:
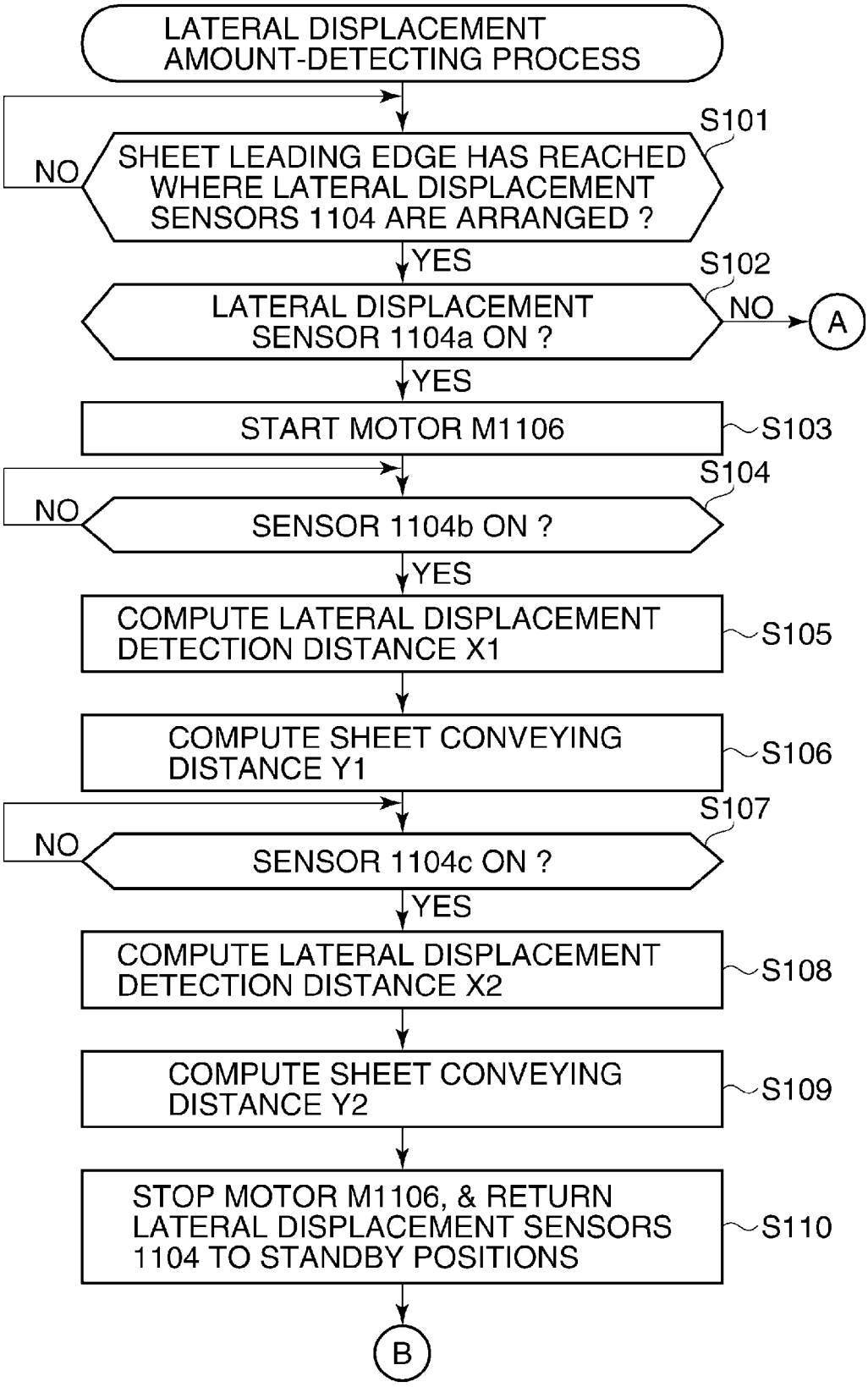
FIG. 9 is a flowchart of a lateral displacement amount-detecting process executed by the sheet processing apparatus.
Figure 10:
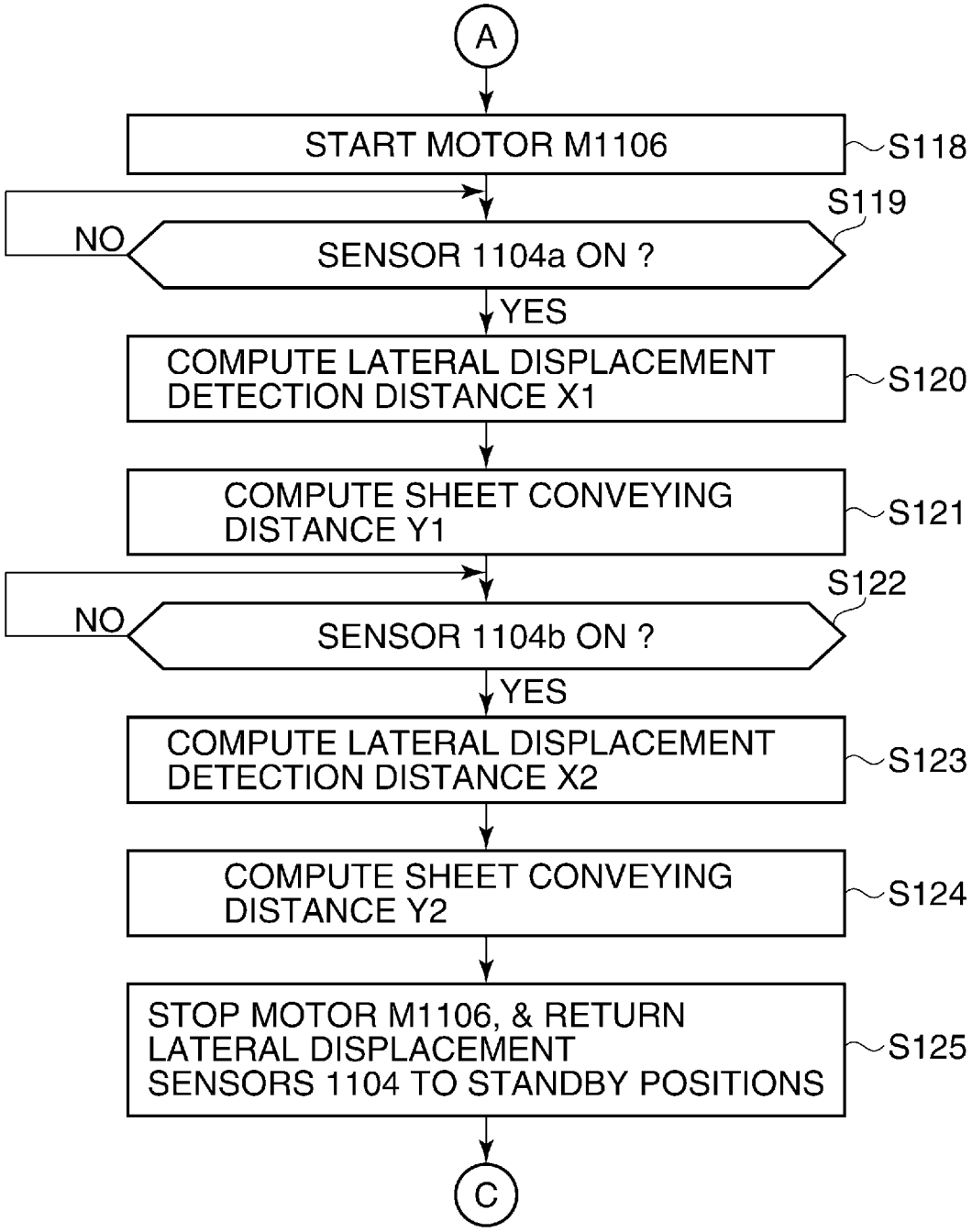
FIG. 10 is a continuation of FIG. 9.
Figure 11:
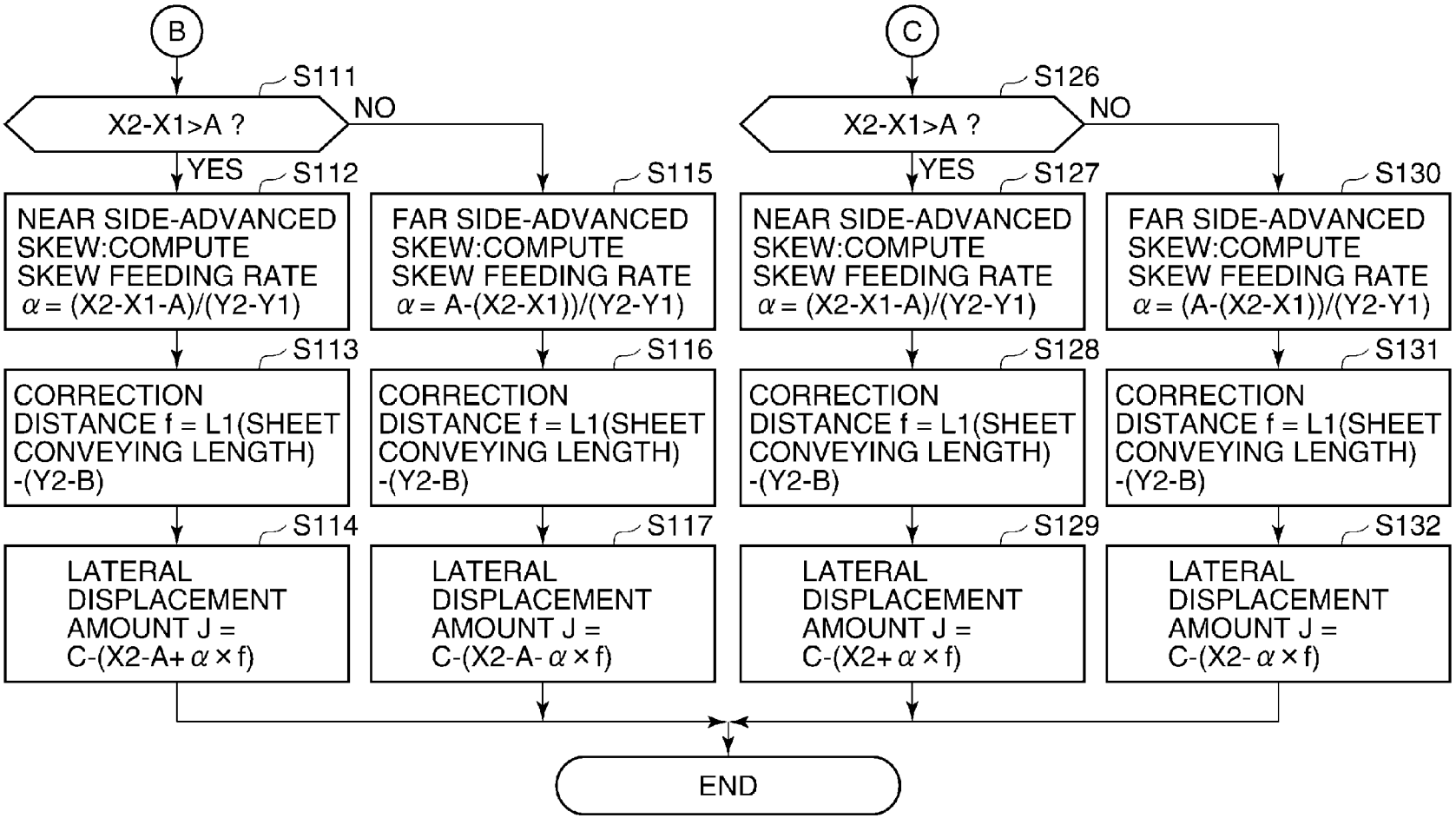
FIG. 11 is a continuation of FIGS. 9 and 10.

FIGS. 9, 10, and 11 are flowcharts of the lateral displacement amount-detecting process executed by the sheet processing apparatus.

Referring to FIGS. 9 to 11, first, the finisher controller 501 of the sheet processing apparatus waits for the leading edge of a sheet to reach a zone where the lateral displacement sensors 1104 (1104*a*, 1104*b*, and 1104*c*) are arranged (step S101). The finisher controller 501 checks, in predetermined timing after the leading edge of the sheet P1 has reached the zone where the lateral displacement sensors 1104*a* to 1104*c* are arranged, whether or not the lateral displacement sensor

1104*a* located at a position closest to the center position of the sheet in the sheet width direction is on (step S102).

If the lateral displacement sensor 1104*a* is on, the finisher controller 501 performs the following motor control: The finisher controller 501 starts driving the lateral displacement sensor-shifting motor M1106 such that the lateral displacement sensors 1104*a* to 1104*c* are shifted in a direction toward the sheet (from the far side of the sheet processing apparatus toward the near side thereof, in the present embodiment) (step S103). Note that in the lateral displacement sensor unit 1105 in the standby position, the standby position 902 of the lateral displacement sensor 1104*b* is on a far side of the sheet lateral edge position 904 corresponding to the limit of the lateral displacement, and hence when the lateral displacement sensor 1104*a* is on in the step S102, the lateral displacement sensors 1104*b* and 1104*c* are not on. The finisher controller 501 detects the lateral displacement amount and a skew of the sheet, using the lateral displacement sensors 1104*b* and 1104*c*. In the following, a description will be given of a method of detecting the lateral displacement amount and a skew.

First, the finisher controller 501 waits for the lateral displacement sensor 1104*b* to be turned on (step S104). When the lateral displacement sensor 1104*b* is turned on, the finisher controller 501 computes a lateral displacement detection distance X1 shown in FIG. 12, and stores the same in the RAM 552 (step S105).

Figure 12:
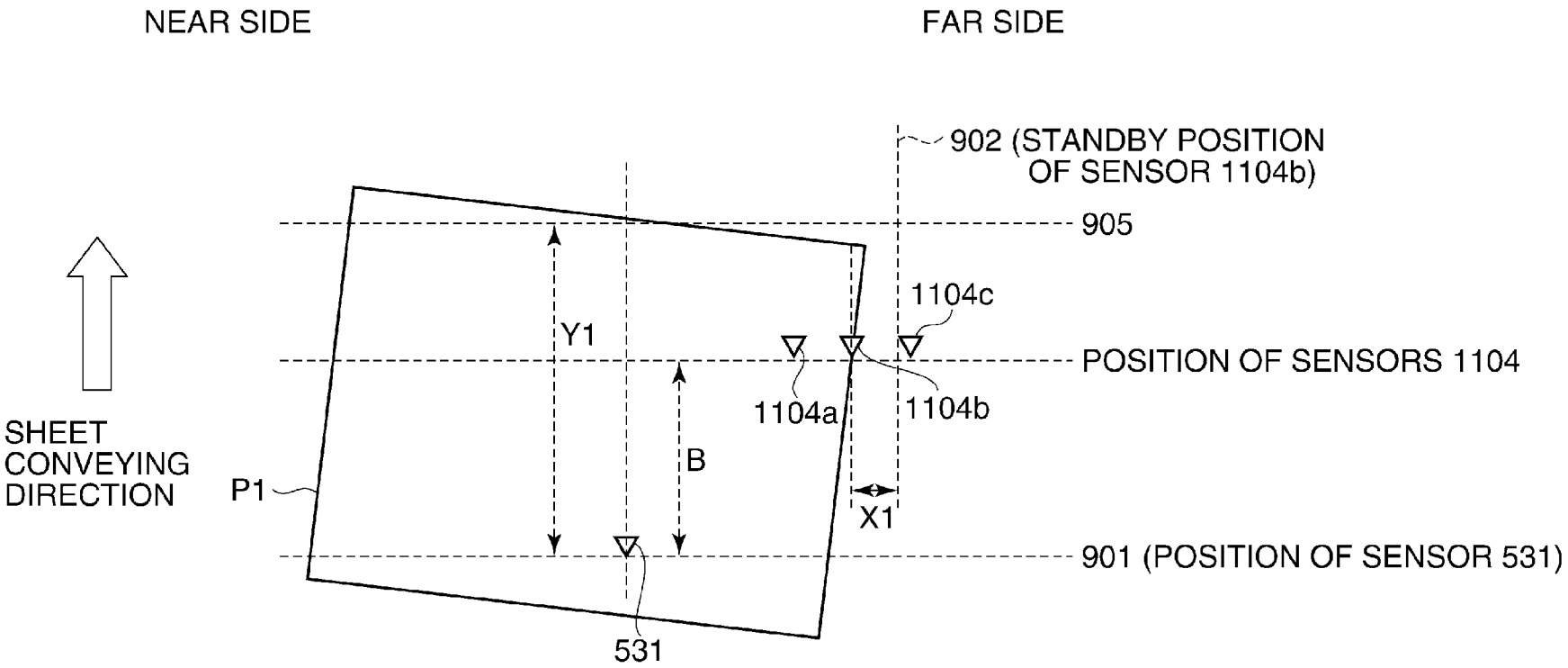
FIG. 12 is a view showing a positional relationship between a sheet, a lateral displacement detection distance X1, and a sheet conveying distance Y1.

FIG. 12 shows the positional relationship between the sheet P1, the lateral displacement detection distance X1, and a sheet conveying distance Y1. As shown in FIG. 12, the lateral displacement detection distance X1 is a distance over which the lateral displacement sensor unit 1105 has been shifted from when the lateral displacement sensor 1104*b* started to be shifted from the standby position 902 to when the lateral displacement sensor 1104*b* has detected the lateral edge of the sheet P1 (edge of the sheet P1 in the sheet width direction). That is, the lateral displacement detection distance X1 is a first position of the edge of the sheet in the sheet width direction. The lateral displacement detection distance X1 can be determined based on the amount of driving of the lateral displacement sensor-shifting motor M1106.

Next, in order to determine a point (position) of the sheet in the sheet conveying direction where the lateral edge of the sheet was detected and with reference to which the lateral displacement detection distance X1 has been computed in the step S105, the finisher controller 501 performs the following computation: The finisher controller 501 computes a sheet conveying distance Y1 over which the sheet P1 has been conveyed from when the inlet sensor 531 detected the sheet P1, and stores the sheet conveying distance Y1 in the RAM 552 (step S106).

As shown in FIG. 12, the sheet conveying distance Y1 is a distance over which the sheet P1 has been conveyed from when the inlet sensor 531 detected the sheet P1 to when the lateral displacement sensor 1104*b* has detected the lateral edge of the sheet P1. A position 901 is a position of the inlet sensor 531 in the sheet conveying direction, and a position 905 is a leading edge position of the sheet P1 at a time point when the lateral displacement sensors 1104 has detected the lateral edge of the sheet P1. The sheet conveying distance Y1 is computed based on the amount of driving of the conveying motor M1103.

Next, the finisher controller 501 waits for the lateral displacement sensor 1104*c* to be turned on (step S107). When the lateral displacement sensor 1104*c* is turned on, the finisher controller 501 performs the following computation: The finisher controller 501 computes a lateral displacement detection distance X2 based on a distance over which the lateral displacement sensor unit 1105 has been shifted from when it started to be shifted by the driving of the lateral displacement sensor-shifting motor M1106, and stores the lateral displacement detection distance X2 in the RAM 552 (step S108).

Figure 13:
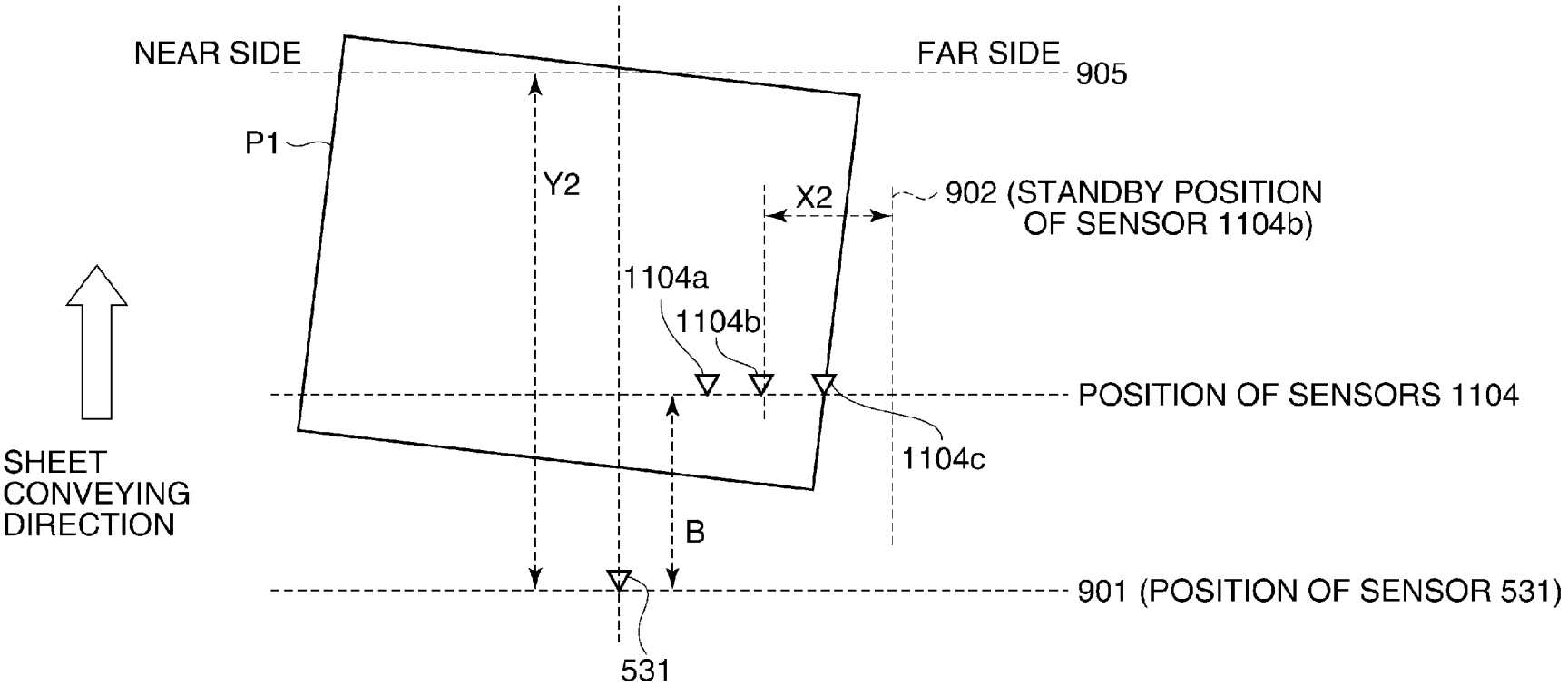
FIG. 13 is a view showing a positional relationship between a sheet, a lateral displacement detection distance X2, and a sheet conveying distance Y2.

FIG. 13 shows the positional relationship between the sheet, the lateral displacement detection distance X2, and a sheet conveying distance Y2. As shown in FIG. 13, the lateral displacement detection distance X2 is a distance over which the lateral displacement sensor unit 1105 has been shifted from when the lateral displacement sensor 1104*b* started to be shifted from the standby position 902 to when the lateral displacement sensor 1104*c* has detected the lateral edge of the sheet P1. That is, the lateral displacement detection distance X2 is a second position of the edge of the sheet P1 in the sheet width direction. The shift distance X2 can be determined based on the amount of driving of the lateral displacement sensor-shifting motor M1106.

Next, in order to determine a point (position) in the sheet conveying direction where the lateral edge of the sheet was detected and with reference to which the lateral displacement detection distance has been computed in the step S108, the finisher controller 501 performs the following computation: The finisher controller 501 computes a sheet conveying distance Y2 from when the inlet sensor 531 has been turned on, and stores the sheet conveying distance Y2 in the RAM 552 (step S109).

Referring to FIG. 13, the sheet conveying distance Y2 is a distance from the position 901 where the inlet sensor 531 has been turned on to a leading edge position 906 of the sheet P1 at a time point when the lateral displacement sensor 1104*c* has detected the lateral edge of the sheet P1. Since the lateral displacement amount is detected while conveying the sheet P1, the relative position of the sheet P1 with respect to the lateral displacement sensors 1104 (1104*a*, 1104*b*, and 1104*c*) vary.

Next, the finisher controller 501 stops the lateral displacement sensor-shifting motor M1106, and after the lapse of a preset time period, returns the lateral displacement sensors 1104*a*, 1104*b*, and 1104*c* to the respective standby positions thereof again (step S110).

Next, in order to determine an orientation of a skew of a sheet, the finisher controller 501 performs the following judgment: The finisher controller 501 judges whether or not the difference X2−X1 between the lateral displacement detection distance X2 (second time) and the lateral displacement detection distance X1 (first time) stored in the RAM 552 is larger than the sensor spacing A (FIG. 4) between the lateral displacement sensors 1104*a*, 1104*b*, and 1104*c* (step S111).

If it is determined that the difference X2−X1 between the lateral displacement detection distance X2 and the lateral displacement detection distance X1 is larger than the sensor spacing A, the finisher controller 501 performs the following computation: The finisher controller 501 determines that the sheet is inclined in such a direction that the near side of the sheet is more advanced than the far side of the same (hereinafter referred to as the "near side-advanced skew"), and computes a skew feeding rate $\alpha$ (step S112).

The skew feeding rate $\alpha$ is an amount of change in the lateral displacement detection distance per a length of 1 mm in the sheet conveying direction. Because of the near side-advanced skew of the sheet P1, it is possible to compute the difference between the lateral displacement detection distances due to skew feeding, by subtracting the sensor spacing A from the difference X2−X1 between the lateral displacement detection distance X2 and the lateral displacement detection distance X1.

Further, it is possible to compute the skew feeding rate α by dividing the determined difference between the lateral displacement detection distances by a sheet conveying distance from when the lateral displacement detection distance X1 was detected to when the lateral displacement detection distance X2 was detected. This sheet conveying distance from when the lateral displacement detection distance X1 was detected to when the lateral displacement detection distance X2 was detected is a difference between the sheet conveying distance Y2 (second time) and the sheet conveying distance Y1 (first time) stored in the RAM 552.

As described above, the skew feeding rate α can be computed by the following equation (1):

$$\alpha=(X2-X1-A)/(Y2-Y1) \quad (1)$$

Figure 14:
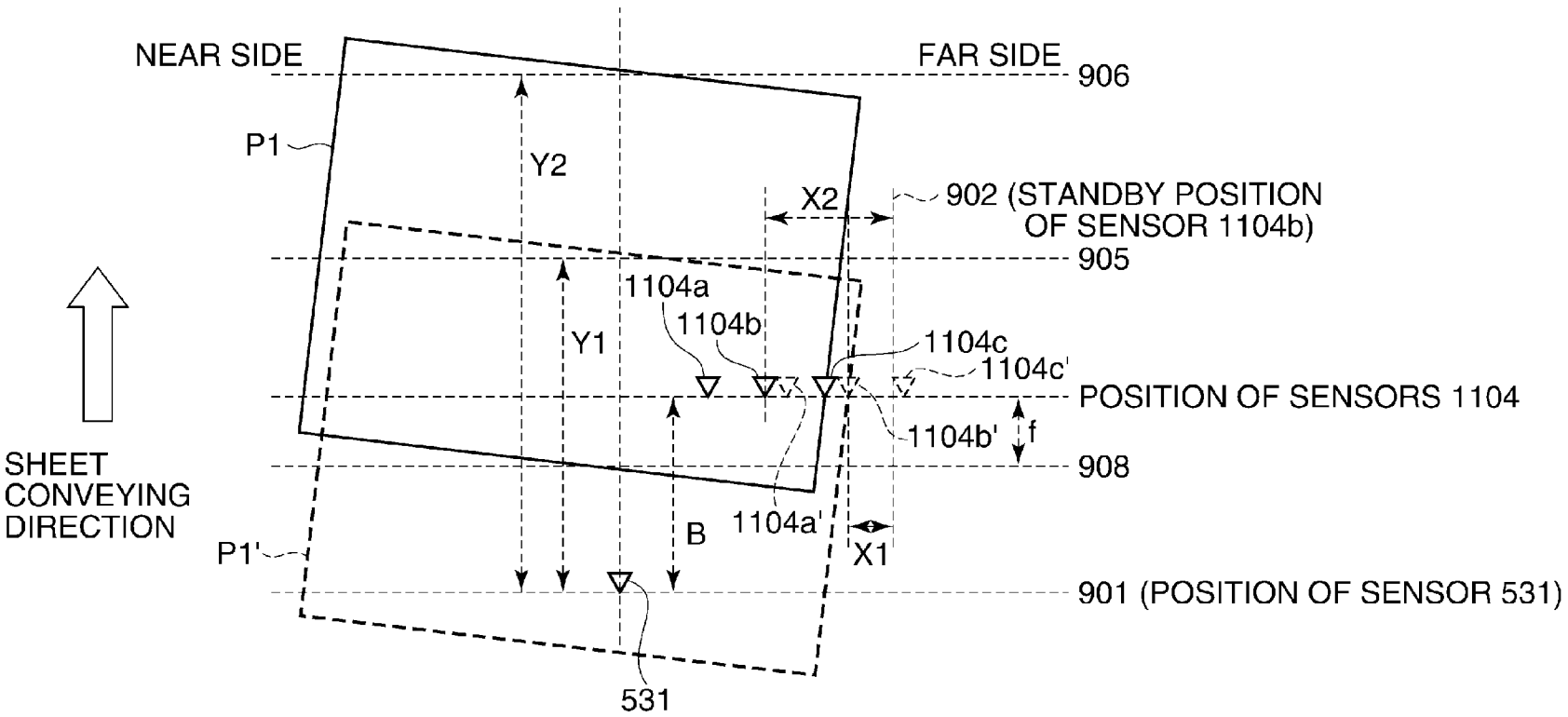
FIG. 14 is a view showing a relationship between a sheet and a correction distance f.

Then, the finisher controller 501 computes a correction distance f (step S113). The correction distance f will be described with reference to FIG. 14. FIG. 14 shows a state in which the FIG. 12 state of the sheet and the FIG. 13 state of the sheet are superimposed one upon the other. In FIG. 14, 1104*a*', 1104*b*', and 1104*c*' represent the respective positions of the lateral displacement sensors 1104*a*, 1104*b*, and 1104*c*, and P1' represents the position of the sheet P1 in the FIG. 12 state. The correction distance f is a distance from the position of the lateral displacement sensors 1104 in the conveying direction at the time of detection of the lateral edge of the sheet P1 by the lateral displacement sensor 1104*c* to a position 908 in the conveying direction where the trailing edge of the sheet P1 intersects at this time with a sheet conveying path center line on which the inlet sensor 531 is disposed. The lateral displacement correction is performed with reference to the lateral edge position of the sheet P1 detected when the trailing edge of the sheet P1 is at the position 908.

To compute the correction distance f, first, a distance B from the inlet sensor 531 to the lateral displacement sensors 1104 is subtracted from the sheet conveying distance Y2. This determines a distance in the conveying direction from the leading edge of the sheet P1 to the position where the lateral displacement detection distance X2 has been detected. The correction distance f is obtained by subtracting this determined distance from a length L1 of the sheet P1 in the sheet conveying direction.

As described above, the correction distance f can be computed by the following equation (2):

$$f=L1-(Y2-B) \quad (2)$$

Figure 15:
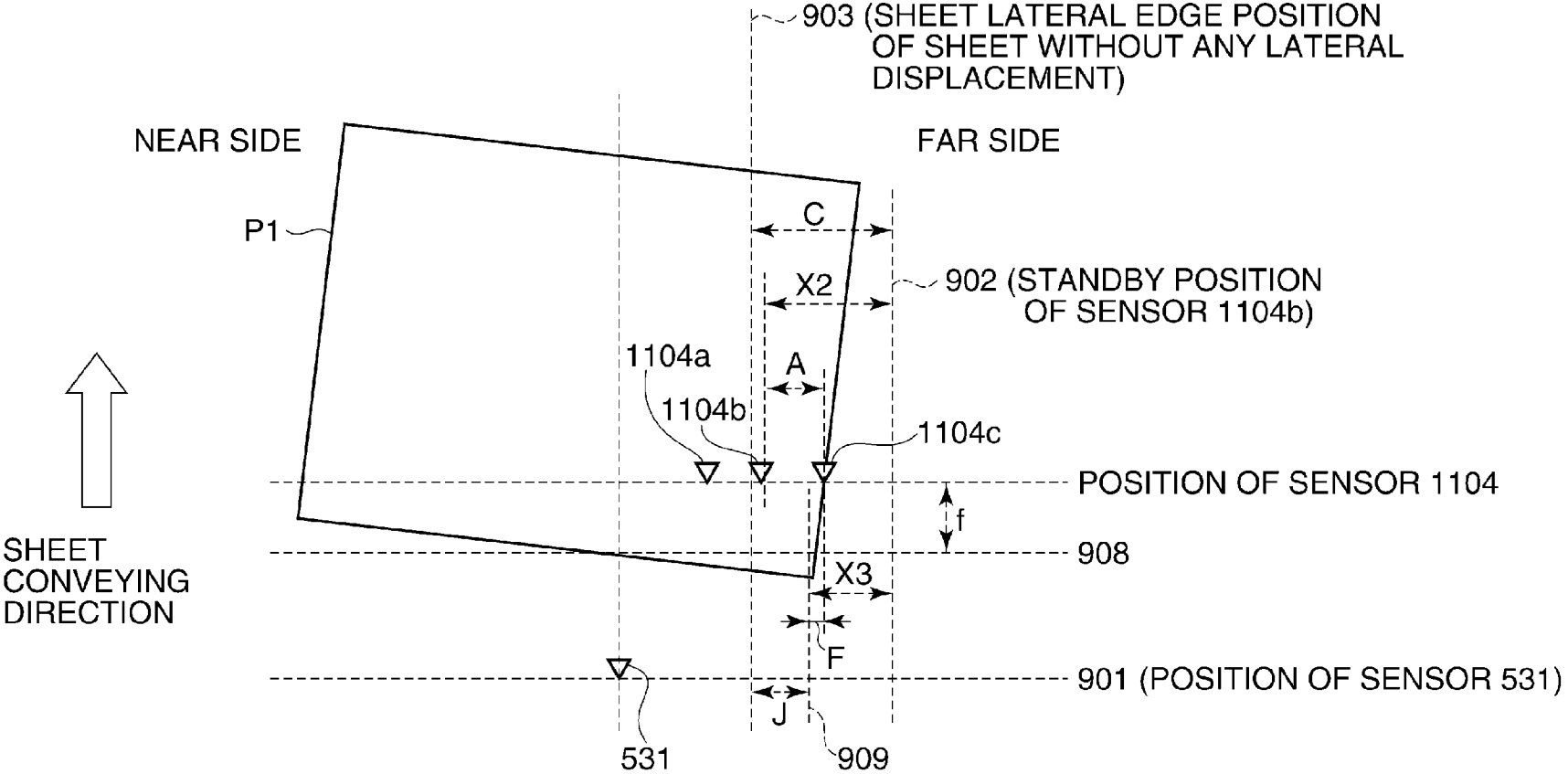
FIG. 15 is a view showing a relationship between a sheet and a lateral displacement amount J.

Next, the finisher controller 501 computes a lateral displacement amount J (step S114). The lateral displacement amount J will be explained with reference to FIG. 15. FIG. 15 shows the sheet in the same state as shown in FIG. 13. Referring to FIG. 15, the lateral displacement amount J is a distance over which the sheet P1 is to be shifted in the sheet width direction when lateral displacement correction is performed, and is equal to a distance from a lateral edge position 909 of the trailing edge of the sheet P1 when the trailing edge of the sheet P1 is at the position 908 in the conveying direction to the sheet lateral edge position 903 of the sheet without any lateral displacement. That is, the lateral displacement amount J corresponds to a distance over which the sheet is shifted to a third position of the edge of the sheet in the sheet width direction. The lateral displacement amount J is computed in the following manner.

As shown in FIG. 15, because of the near side-advanced skew of the sheet P1, the lateral displacement detection distance X2 changes such that it becomes larger as the position on the sheet is closer to the trailing edge of the sheet P1. Therefore, an amount F of change from the lateral edge position detected by the lateral displacement sensor 1104*c* to the lateral edge position to be detected when the sheet is at the position 908 in the conveying direction is equal to α×f.

It is possible to compute the lateral displacement amount J by subtracting a lateral displacement detection distance X3 when the sheet is at the position 908 in the conveying direction from a distance C between the sheet lateral edge position 903 of the sheet without any lateral displacement and the standby position 902 of the lateral displacement sensor 1104*b* (hereinafter referred to as the "lateral displacement sensor standby position distance C"). As is apparent from FIG. 15, X3 becomes equal to a value computed by adding F to (X2−A).

Therefore, the lateral displacement amount J can be computed by the following equation (3):

$$J=C-(X2-A+\alpha\times f) \quad (3)$$

When the computed lateral displacement amount J is a positive value, the sheet P1 is determined to be displaced toward the far side, whereas when the computed lateral displacement amount J is a negative value, the sheet P1 is determined to be displaced toward the near side. After the lateral displacement amount J is computed, the present process is terminated. This makes it possible to obtain a lateral displacement amount in the vicinity of the trailing edge of the sheet P1.

On the other hand, if it is determined in the step S111 that that the difference X2−X1 between the lateral displacement detection distance X2 and the lateral displacement detection distance X1 is not larger than the sensor spacing A, the finisher controller 501 performs the following computation: The finisher controller 501 determines that the sheet is inclined in such a direction that the far side of the sheet is more advanced than the near side of the same (hereinafter referred to as the "far side-advanced skew"), and computes the skew feeding rate α (step S115).

Because of the far side-advanced skew of the sheet P1, it is possible to compute the difference between the lateral displacement detection distances due to skew feeding, by subtracting the difference X2−X1 between the lateral displacement detection distance X2 and the lateral displacement detection distance X1 from the sensor spacing A. Further, it is possible to compute the skew feeding rate α by dividing the determined difference between the lateral displacement detection distances by the sheet conveying distance from when the lateral displacement detection distance X1 was detected to when the lateral displacement detection distance X2 was detected.

As described above, the skew feeding rate α can be computed by the following equation (4):

$$\alpha=(A-(X2-X1))/(Y2-Y1) \quad (4)$$

Next, the finisher controller 501 computes the correction distance f (step S116). The method of computing the correction distance f is the same as the method employed in the step S113, and hence description thereof is omitted.

Next, the finisher controller 501 computes the lateral displacement amount J (step S117). Because of the far side-advanced skew of the sheet P1, the lateral displacement detection distance X2 changes such that it becomes smaller as the position on the sheet is closer to the trailing edge of the sheet P1. Therefore, the lateral displacement detection distance X3 at the position 908 is obtained by subtracting F (=α×f) from (X2−A).

By subtracting the lateral displacement detection distance X3 at the position 908 from the lateral displacement sensor standby position distance C, it is possible to compute the lateral displacement amount J.

As described hereinabove, the lateral displacement amount J can be computed by the following equation (5):

$$J=C-(X2-A-\alpha\times f) \quad (5)$$

When the computed lateral displacement amount J is a positive value, the sheet P1 is determined to be displaced toward the far side, whereas when the computed lateral displacement amount J is a negative value, the sheet P1 is determined to be displaced toward the near side. After the lateral displacement amount J is computed, the present process is terminated.

On the other hand, if it is determined in the step S102 that the lateral displacement sensor 1104*a* is not on, the finisher controller 501 performs the following motor control: The finisher controller 501 starts driving the lateral displacement sensor-shifting motor M1106 such that the lateral displacement sensors 1104*a* to 1104*c* are shifted in a direction toward the sheet (from the far side of the sheet processing apparatus toward the near side, in the present embodiment) (step S118). Then, the finisher controller 501 waits for the lateral displacement sensor 1104*a* to be turned on (step S119). In a case where the lateral displacement sensor 1104*a* is not on, the lateral displacement sensors 1104*a* and 1104*c* are not on, either.

When the lateral displacement sensor 1104*a* is turned on, the finisher controller 501 performs the following computation: The finisher controller 501 computes the lateral displacement detection distance X1 based on a distance over which the lateral displacement sensor unit 1105 has been shifted from when it started to be shifted by the driving of the lateral displacement sensor-shifting motor M1106, and stores the computed value of the lateral displacement detection distance X1 in the RAM 552 (step S120).

Next, in order to determine a point (position) in the sheet conveying direction where the lateral edge of the sheet was detected and with reference to which the lateral displacement detection distance has been computed in the step S120, the finisher controller 501 performs the following computation: The finisher controller 501 computes the sheet conveying distance Y1 from when the inlet sensor 531 was turned on, and stores the sheet conveying distance Y1 in the RAM 552 (step S121).

Next, the finisher controller 501 waits for the lateral displacement sensor 1104*b* to be turned on (step S122). When the lateral displacement sensor 1104*b* is turned on, the finisher controller 501 performs the following computation: The finisher controller 501 computes the lateral displacement detection distance X2 based on a distance over which the lateral displacement sensor unit 1105 has been shifted from when it started to be shifted by driving of the lateral displacement sensor-shifting motor M1106, and stores the lateral displacement detection distance X2 in the RAM 552 (step S123).

Next, in order to determine a point (position) of the sheet in the sheet conveying direction where the lateral edge of the sheet was detected and with reference to which the lateral displacement detection distance has been computed, the finisher controller 501 performs the following computation: The finisher controller 501 computes the sheet conveying distance Y2 from when the inlet sensor 531 was turned on, and stores the sheet conveying distance Y2 in the RAM 552 (step S124).

Next, the finisher controller 501 stops the lateral displacement sensor-shifting motor M1106, and after the lapse of the preset time period, returns the lateral displacement sensors 1104*a*, 1104*b*, and 1104*c* to the respective standby positions thereof again (step S125).

Next, the finisher controller 501 performs the following determination in order to determine an orientation of a skew of the sheet: The finisher controller 501 judges whether or not the difference X2−X1 between the lateral displacement detection distance X2 and the lateral displacement detection distance X1 stored in the RAM 552 is larger than the sensor spacing A (FIG. 4) between the lateral displacement sensors 1104*a*, 1104*b*, and 1104*c* (step S126).

If it is determined that the difference X2−X1 between the lateral displacement detection distance X2 and the lateral displacement detection distance X1 is larger than the sensor spacing A, the finisher controller 501 determines that the skew of the sheet P1 is the near side-advanced skew, and computes the skew feeding rate α (step S127). The method of computing the skew feeding rate α is the same as the method employed in the step S112, and hence description thereof is omitted.

Next, the finisher controller 501 computes the correction distance f (step S128). The method of computing the correction distance f is the same as the method employed in the step S113, and hence description thereof is omitted.

Next, the finisher controller 501 computes the lateral displacement amount J (step S129). Because of the near side-advanced skew of the sheet, the lateral displacement detection distance X2 changes such that it becomes larger as the position on the sheet is closer to the trailing edge of the sheet. Therefore, the lateral displacement detection distance X3 at the position 908 is a value computed by adding the amount F of change in lateral edge position to the lateral displacement detection distance X2. By subtracting the lateral displacement detection distance X3 from the lateral displacement sensor standby position distance C, it is possible to compute the lateral displacement amount J.

As described above, the lateral displacement amount J can be computed by the following equation (6):

$$J=C-(X2+\alpha\times f) \quad (6)$$

When the computed lateral displacement amount J is a positive value, the sheet P1 is determined to be displaced toward the far side, whereas when the computed lateral displacement amount J is a negative value, the sheet P1 is determined to be displaced toward the near side. After the lateral displacement amount J is computed, the present process is terminated.

On the other hand, if it is determined in the step S126 that that the difference X2−X1 between the lateral displacement detection distance X2 and the lateral displacement detection distance X1 is not larger than the sensor spacing A, the finisher controller 501 performs the following computation: The finisher controller 501 determines that the skew of the sheet P1 is the far side-advanced skew, and computes the skew feeding rate α (step S130). The method of computing the skew feeding rate α is the same as the method employed in the step S115, and hence description thereof is omitted.

Next, the finisher controller 501 computes the correction distance f (step S131). The method of computing the correction distance f is the same as the method employed in the step S116, and hence description thereof is omitted.

Next, the finisher controller 501 computes the lateral displacement amount J (step S132). Because of the far side-advanced skew of the sheet, the lateral displacement detection distance X2 changes such that it becomes smaller as the position on the sheet is closer to the trailing edge of the sheet. Therefore, the lateral displacement detection distance X3 at the position 908 is a value computed by subtracting the amount F of change in lateral edge position from the lateral displacement detection distance X2. By subtracting the lateral displacement detection distance X3 from the lateral displacement sensor standby position distance C, it is possible to compute the lateral displacement amount J.

As described above, the lateral displacement amount J can be computed by the following equation (7):

$$J=C-(X2-\alpha\times f) \quad (7)$$

When the computed lateral displacement amount J is a positive value, the sheet P1 is determined to be displaced toward the far side, whereas when the computed lateral displacement amount J is a negative value, the sheet P1 is determined to be displaced toward the near side. After the lateral displacement amount J is computed, the present process is terminated.

As described heretofore, according to the present embodiment, it is possible to obtain the following advantageous effects: A plurality of lateral displacement sensors 1104*a*, 1104*b*, and 1104*c* are arranged in a sheet width direction orthogonal to a sheet conveying direction, whereby by shifting the lateral displacement sensors in one direction, it is possible to detect the lateral displacement amount of a sheet at a plurality of points of an edge of the sheet in the sheet width direction while conveying the sheet.

More specifically, in the lateral displacement amount-detecting process, the direction of shifting the lateral displacement sensor unit 1105 is made fixed when measuring the lateral displacement amount of a sheet a plurality of times, whereby it is possible to detect the lateral displacement amount with high accuracy. Further, a plurality of detections of the lateral displacement amount can be performed by one shifting operation of the lateral displacement sensors, thereby making it possible to enhance the productivity of sheet processing. Further, the lateral displacement amount at the position 908 corresponding to the trailing edge of the sheet is computed based on the skew feeding rate of the sheet determined using the lateral displacement amounts detected the plurality of times, and hence it is possible to reduce the detection error of the lateral displacement amount caused by skew feeding of the sheet.

This makes it possible to detect the lateral displacement amount and the skew of the sheet at a higher speed than the conventional case where a lateral displacement sensor is caused to reciprocate. Further, since the detections by the lateral displacement sensors can be performed in one direction, it is possible to accurately detect the lateral displacement amount and the skew of the sheet. The lateral displacement amount can be corrected based on a lateral displacement amount at the position corresponding to the trailing edge of the sheet, where holes are punched, whereby it is possible to improve accuracy of punching positions on the sheet.

Although in the above described embodiment, the description has been given of processing for predicting a lateral displacement amount of a sheet at a location corresponding to the trailing edge thereof in the sheet conveying direction, by taking as an example a case where a hole punching operation for punching holes in the trailing end in the sheet conveying direction is performed, this is not limitative.

For example, the present invention can also be applied, in a case where a hole punching operation for punching holes in the leading end of a sheet in the sheet conveying direction is performed, to processing for predicting a lateral displacement amount of the sheet at a location corresponding to the leading edge thereof in the sheet conveying direction based on the skew feeding rate α of the sheet. In this case as well, it is possible to improve the accuracy of punching positions on the sheet.

Although in the above described embodiment, the description has been given of the case where the lateral displacement sensor unit 1105 and the lateral displacement sensor-shifting motor M1106 are arranged in the sheet processing apparatus, to thereby perform the lateral displacement amount-detecting process in the sheet processing apparatus, this is not limitative.

For example, the present invention can be applied to a case where the lateral displacement sensor unit 1105 and the lateral displacement sensor-shifting motor M1106 are arranged in the conveying path downstream of the sheet feed cassettes of the image forming apparatus, as denoted by reference numeral 1300 in FIG. 1, whereby the lateral displacement amount-detecting process is performed in the image forming apparatus. In this case, the CPU circuit section 150 of the image forming apparatus functions as the determination unit and an adjustment unit of the present invention.

The image forming apparatus forms a toner image in a tilted manner on the photosensitive drum 111 as an image bearing member based on the skew feeding rate α of the sheet computed in the lateral displacement amount-detecting process. That is, image exposure is performed on the photosensitive drum 111 such that the inclination of the sheet and that of an electrostatic latent image formed on the photosensitive drum 111 match each other. The toner image having the inclination thereof adjusted is transferred onto the sheet. This makes it possible to reduce the inclination of an image with respect to the sheet even when the sheet is skewed, whereby it is possible to realize improvement in the accuracy of position of an image formed on the sheet by the image forming apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2011-172933 filed Aug. 8, 2011, which is hereby incorporated by reference herein in its entirety.

What is claimed is:

1. A sheet processing apparatus comprising:

a conveying unit configured to convey a sheet;

a first detection unit and a second detection unit arranged in a sheet width direction orthogonal to a sheet conveying direction and configured to detect an edge of the conveyed sheet in the sheet width direction, respectively;

a first shift unit configured to cause said first detection unit and said second detection unit to shift in the sheet width direction;

a second shift unit configured to cause the sheet to shift in the sheet width direction;

a first determination unit configured to determine, by causing said first shift unit to cause said first detection unit and said second detection unit to shift, during conveyance of the sheet by said conveying unit, a first position of the edge of the sheet in the sheet width direction, the first position being detected by said first detection unit, and then a second position of the edge of the sheet in the sheet width direction, the second position being detected by said second detection unit;

a second determination unit configured to determine a third position of the edge of the sheet in the sheet width direction, the third position being closer to a trailing edge of the sheet than the second position is, based on the first position and the second position determined by said first determination unit, and an amount of conveyance of the sheet till the second position is detected after the first position is detected; and a correction unit configured to correct a displacement of the sheet in the sheet width direction, by causing said second shift unit to shift the sheet in the sheet width direction, according to the third position determined by said second determination unit.

2. The sheet processing apparatus according to claim 1, comprising:

a plurality of sensors arranged in the sheet width direction, the plurality being by at least three; and a selection unit configured to select said first detection unit and said second detection unit used for detecting the edge of the sheet in the sheet width direction, according to states of detection of the sheet by said plurality of sensors when the sheet is conveyed to a predetermined position by said conveying unit.

3. The sheet processing apparatus according to claim 2, wherein in a case where a sensor closest to a center position of the sheet in the sheet width direction has not detected the sheet when the sheet has been conveyed to the predetermined position, said selection unit selects two sensors closer to the center position of the sheet than any other from said plurality of sensors, as said first detection unit and said second detection unit.

4. The sheet processing apparatus according to claim 2, wherein in a case where a sensor closest to a center position of the sheet in the sheet width direction has detected the sheet and a sensor second closest to the center position of the sheet in the sheet width direction has not detected the sheet, said selection unit selects said sensor second closest and a sensor third closest to the center position of the sheet from said plurality of sensors, as said first detection unit and said second detection unit.

5. The sheet processing apparatus according to claim 4, wherein a position of said sensor second closest to the center position before being shifted by said first shift unit is farther from the center position than a position of the lateral edge of the sheet at which the lateral displacement which can be corrected by said correction unit becomes maximum is.

6. The sheet processing apparatus according to claim 1, further comprising:

a punching unit configured to punch holes in the sheet; and a punch control unit configured to control positions of the holes to be punched by said punching unit according to the third position determined by said second determination unit.

7. The sheet processing apparatus according to claim 1, wherein said first shift unit causes said first detection unit and said second detection unit to be shifted in unison.

8. A method of controlling a sheet processing apparatus including a conveying unit configured to convey a sheet, a first detection unit and a second detection unit arranged in a sheet width direction orthogonal to a sheet conveying direction and configured to detect an edge of the conveyed sheet in the sheet width direction, respectively, a first shift unit configured to cause said first detection unit and said second detection unit to shift in the sheet width direction, and a second shift unit configured to cause the sheet to shift in the sheet width direction, the method comprising:

determining, by causing the first shift unit to cause the first detection unit and the second detection unit to shift, during conveyance of the sheet by the conveying unit, a first position of the edge of the sheet in the sheet width direction, the first position being detected by the first detection unit, and then a second position of the edge of the sheet in the sheet width direction, the second position being detected by the second detection unit;

determining a third position of the edge of the sheet in the sheet width direction, the third position being closer to a trailing edge of the sheet than the second position is, based on the first position and the second position determined by said determining, and an amount of conveyance of the sheet till the second position is detected after the first position is detected; and correcting a displacement of the sheet in the sheet width direction, by causing the second shift unit to shift the sheet in the sheet width direction, according to the determined third position.

* * * * *